US007265742B2

(12) United States Patent
Iisaka

(10) Patent No.: US 7,265,742 B2
(45) Date of Patent: Sep. 4, 2007

(54) LIQUID CRYSTAL DEVICE, DRIVE METHOD THEREFOR, AND PROJECTION TYPE DISPLAY APPARATUS

(75) Inventor: Hidehito Iisaka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 456 days.

(21) Appl. No.: 10/667,340

(22) Filed: Sep. 23, 2003

(65) Prior Publication Data

US 2005/0099379 A1 May 12, 2005

(30) Foreign Application Priority Data

Sep. 30, 2002 (JP) ..... 2002-287449
Jul. 17, 2003 (JP) ..... 2003-198659

(51) Int. Cl.
*G09G 3/36* (2006.01)

(52) U.S. Cl. ..... 345/100; 345/54; 345/96; 345/209

(58) Field of Classification Search ..... 345/100, 345/209, 54, 96, 87
See application file for complete search history.

(56) References Cited

U.S. PATENT DOCUMENTS 5,907,314 A 5/1999 Negishi et al. ..... 345/103
6,335,719 B1 * 1/2002 An et al. ..... 345/98
6,819,311 B2 * 11/2004 Nose et al. ..... 345/100
2001/0003448 A1 6/2001 Nose et al. ..... 345/100
2003/0189537 A1 * 10/2003 Yun ..... 345/87

FOREIGN PATENT DOCUMENTS

JP A 5-313608 11/1993
JP 11-295697 A 10/1999
JP 2001-209027 A 8/2001

* cited by examiner

*Primary Examiner*—Sumati Lefkowitz
*Assistant Examiner*—Seokyun Moon
(74) *Attorney, Agent, or Firm*—Oliff & Berridge, PLC

(57) ABSTRACT

An object of the present invention is to provide a liquid crystal device which can suppress cross-talk and can maintain uniformity of the display quality within the screen, and for which problems such as insufficient writing do not occur. In a liquid crystal light valve of the invention, an image signal for which the polarity is inverted for each one horizontal period, is supplied to each data line, and for each horizontal period plural pulse signals which each rise at a different timing, are supplied to each of plural scanning lines while skipping one part of the scanning lines. Moreover driving is such that in any one horizontal period, plural scanning lines, to which is supplied a pulse signal rising at a timing corresponding to an application period of a positive polarity potential, are adjacent to each other, and plural scanning lines, to which is supplied a pulse signal rising at a timing corresponding to an application period of a negative polarity potential, are adjacent to each other.

5 Claims, 17 Drawing Sheets

FIG. 10

TIME (UNIT; HORIZONTAL PERIOD)

| | 1 | 2 | 3 | 4 | 5 | 6 | 7 | 8 |
|---|---|---|---|---|---|---|---|---|
| $G_1$ | + | + | ► − | − | − | − | − | − |
| $G_2$ | + | + | + | + | ► − | − | − | − |
| • | + | + | + | + | + | + | ► − | − |
| • | + | + | + | + | + | + | + | + |
| • | + | + | + | + | + | + | + | + |
| • | + | + | + | + | + | + | + | + |
| • | + | + | + | + | + | + | + | + |
| • | + | + | + | + | + | + | + | + |
| • | + | + | + | + | + | + | + | + |
| • | + | + | + | + | + | + | + | + |
| $G_m$ | + | + | + | + | + | + | + | + |
| $G_{m+1}$ | − | ► + | + | + | + | + | + | + |
| $G_{m+2}$ | − | − | − | ► + | + | + | + | + |
| • | − | − | − | − | − | ► + | + | + |
| • | − | − | − | − | − | − | − | ► + |
| • | − | − | − | − | − | − | − | − |
| • | − | − | − | − | − | − | − | − |
| • | − | − | − | − | − | − | − | − |
| • | − | − | − | − | − | − | − | − |
| • | − | − | − | − | − | − | − | − |
| $G_{2m}$ ► | − | − | − | − | − | − | − | − |

► POSITION OF GATE LINE WHICH PERFORMS WRITING

LIQUID CRYSTAL DEVICE, DRIVE METHOD THEREFOR, AND PROJECTION TYPE DISPLAY APPARATUS

BACKGROUND OF THE INVENTION

1. Field of the Invention

The present invention relates to a liquid crystal display, a drive method therefor, and a projection type display apparatus, and in particular, relates to a liquid crystal display suitable for use in a liquid crystal light valve mounted in a projection type display apparatus, and to a drive method therefor.

2. Description of Related Art

As a light modulation device mounted in a projection type display apparatus such as a liquid crystal projector, a liquid crystal light valve is known. The liquid crystal light valve is essentially constructed as a pair of substrates arranged facing each other with a liquid crystal layer therebetween, and is furnished with electrodes for applying a voltage to the liquid crystal layer. Normally, a liquid crystal cell of an active matrix type is used for the liquid crystal light valve, and higher resolution for the image is achieved.

In the drive method for a liquid crystal light valve, in order to prevent burnout or deterioration of the liquid crystal, an inversion drive method, such as dot inversion, line inversion, and surface inversion, has heretofore been adopted. There are both advantages and disadvantages for these inversion drive methods; however, in the case of dot inversion or line inversion, while there is an advantage in being able to control cross-talk, since a potential having an inverted polarity is written to each of adjacent pixel electrodes, a transverse electric field is generated between the adjacent pixels, and there is therefore the likelihood of light passing through caused by disclination due to this transverse electric field. As described above, due to the circumstances in which high resolution is demanded for the liquid crystal light valve, the light passing described above causes a drop in contrast or reduction in opening ratio, becoming a signification factor in reducing display quality. Therefore, from this viewpoint, there is a need to adopt the surface inversion drive method in which transverse electric fields do not occur.

However, in the surface inversion drive method, there are other problems.

That is to say, in the surface inversion drive method, in the case of observing one data line, then with respect to all of the pixels to which signals are supplied from the aforementioned data line, if the inversion period is set to one field, then an image signal (potential) of the same polarity is written in one predetermined field. Then, at the moment of shifting to the next field, the polarity of the image signal supplied to this data line is inverted. At this time, in the case where the scanning lines are scanned from the upper stage side to the lower stage side of the display area, there is the condition where at the pixels on the upper stage side of the display area, after the image signal is written, then in the time of approximately the hold period, the polarity of the image signal applied to the relevant data line is the same polarity as the potential of the pixel, while in contrast to this, at the pixels on the lower stage side, after the image signal is written, then in the time of approximately the hold period, an image signal of the polarity inverted to that of the pixel is applied to the data line. In this manner, at the upper stage side and lower stage side of the display area, a difference occurs in the influence that the potential of the data line provides on the pixel electrode. For this reason, there is a problem in that the display becomes non-uniform depending on the location on the screen.

Therefore, as a device which can suppress cross-talk, and which can secure uniformity of the screen, there has been proposed a technique where one horizontal period is divided into a first period and a second period, and in the first period, a driving pulse is supplied to a scanning line, and at the same time, an image signal is supplied to a data line to thereby apply an image signal to each pixel electrode, while on the other hand, in the second period, an image signal having the polarity inverted to the previous polarity is supplied to the data line without supplying a driving pulse to the scanning line, for example, in Japanese Unexamined Patent Application, First Publication No. Hei 5-313608.

However, in the technique disclosed in the above-mentioned patent document, the time which can be used in writing to the pixel is half the normal time, so that problems such as insufficient writing occur.

BRIEF SUMMARY OF THE INVENTION

The present invention addresses the aforementioned problems, and has as an object to provide a liquid crystal device which can suppress cross-talk and can maintain uniformity of the display quality within the screen, and for which problems such as insufficient writing do not occur, and to provide a drive method therefor.

In order to achieve the aforementioned object, a liquid crystal device of the present invention comprises: plural data lines; plural scanning lines intersecting the data lines; pixels connected to the aforementioned data lines and the aforementioned scanning lines; and a driver section which supplies to each of the aforementioned plural data lines an image signal for which the polarity is inverted into a positive polarity potential or a negative polarity potential, for each unit period, and which supplies for each one horizontal period plural pulse signals which each rise at a different timing, to each of the aforementioned plural scanning lines while skipping one part of the aforementioned plural scanning lines; wherein the driving by the aforementioned driver section is performed such that in any one horizontal period, plural scanning lines to which is supplied a pulse signal rising at a timing corresponding to an application period of a positive polarity potential among the aforementioned image signals are adjacent to each other, and plural scanning lines to which is supplied a pulse signal rising at a timing corresponding to an application period of a negative polarity potential among the aforementioned image signals are adjacent to each other.

The driver section in the liquid crystal device of the present invention is one which outputs for the data line side an image signal in which the polarity is inverted for each unit period. For example, when the unit period described above is set to one horizontal period, then for polarity inversion, this performs the same operation as a conventional line inversion drive. On the other hand, for the scanning line side, rather than performing sequential line scanning from the upper stage side to the lower stage side of the screen, this is one which performs scanning over all scanning lines, back and forth while skipping the scanning lines of one part (several lines). Based on the operation of such a driver section, to each of the scanning lines, either a pulse signal which rises at a timing corresponding to the application period of the positive polarity potential of the image signals, or a pulse signal which rises at a timing corresponding to the application period of the negative polarity potential of the image signals is supplied.

At this time, observing any one vertical period, since the plural scanning lines to which is supplied the pulse signal rising at a timing corresponding to the application period of the positive polarity potential are adjacent to each other, and the plural scanning lines to which is supplied the pulse signal rising at a time corresponding to the application period of the negative polarity potential are adjacent to each other, then inside the area corresponding to these adjacent plural scanning lines, there are only present either pixels written with a positive polarity potential or pixels written with a negative polarity potential. Consequently, a positive polarity application area and a negative polarity application area having a width of a certain extent inside the screen are formed, and by inverting these at a predetermined period it is possible to have the same polarity between adjacent pixels in the same manner as for the case where surface inversion driving is carried out for a specific area.

However, in the case of the present invention, consequently, an operation similar to the conventional line inversion driving is performed for the data line side, while also performing surface inversion driving for the specified area. For this reason, a significant difference does not arise in the relationship of the timewise potentials for between the data lines and the pixel electrodes at the pixels of the upper stage side and the pixels of the lower stage side of the screen, as observed when the data line side is driven with the surface inversion method, and non-uniformity of the display depending on the location on the screen can be avoided while suppressing cross-talk. Furthermore, different from the conventional technique "where one horizontal period is divided into a first period and a second period, and in the first period, a driving pulse is supplied to a scanning line, and at the same time, an image signal is supplied to a data line to thereby apply an image signal to each pixel electrode, while on the other hand, in the second period, an image signal having the polarity inverted to the previous polarity is supplied to the data line without supplying a driving pulse to the scanning line", as disclosed above, the majority of the one horizontal period is consumed in writing to the pixel. For this reason, problems such as insufficient writing also do not occur.

Moreover, preferably in one vertical period, an application time of a positive polarity potential and an application time of a negative polarity potential of the image signal supplied to each data line are substantially equal.

According to this configuration, it becomes possible to make substantially all of the data lines alternating current. Furthermore, since for the pixels connected to the data lines, the number of pixels written with the positive polarity potential and the number of pixels written with the negative polarity potential can be made substantially the same, the effect is obtained that the relationship between the data lines and the pixel electrodes in the screen can be made more uniform.

In addition, preferably in one vertical period, two pixel groups corresponding to two adjacent scanning lines are in a condition in which a potential of the same polarity is written for a time of not less than 50% of the one vertical period.

In the case of the present invention, different from the conventional general surface inversion driving, when observing in any one vertical period, there exists within one screen plural areas comprising positive polarity application areas and negative polarity application areas. Consequently, a potential of the same polarity is applied to adjacent pixels within respective areas. However, at the border between the respective areas, a potential of the reversed polarity is applied to the adjacent pixels. Here, the respective areas move on the screen one scanning line at a time for each unit period. For this reason, observing one pixel, there are a time when a potential of the same polarity is written, and a time when a potential of a reversed polarity is written to the adjacent pixels within one vertical period. Here, if the time when a potential of the same polarity is written is 50% or more of the one vertical period, an effect is obtained where light leakage due to transverse electric fields generated when the adjacent pixels have a reversed polarity, can be reduced.

In this specification, the "areas", such as "positive potential application area" and "negative potential application area", do not indicate absolute locations on the screen; instead, they indicate regions where the polarity of application potentials within a predetermined infinitesimal time period are in the same state. Consequently, this "area" moves on the screen over time.

Furthermore, it is preferable that the unit period in which the polarity of the image signal is inverted be one horizontal period.

In the present invention, the "unit period where the polarity of the image signal is inverted" is not limited to one horizontal period, and for example, even if this is plural horizontal period units such as two horizontal periods, four horizontal periods, and so on, the actions and effects of the present invention can be obtained. However, in the case where this is one horizontal period, the effect is obtained that all of the scanning lines can be made to be in the same state. On the other hand, in the case of other than one horizontal period, in the first selected scanning line and the last selected scanning line of the period, a certain difference occurs in the relationship between the data line and the pixel electrode.

As a specific scanning sequence in the liquid crystal device of the present invention, for example, when the number of the aforementioned plural scanning lines is 2m lines, the driver section supplies a pulse signal rising at a timing corresponding to the application period of the aforementioned positive polarity potential to a predetermined scanning line, and then supplies a pulse signal rising at a timing corresponding to the application period of the negative polarity potential to a scanning line separated by m lines from the aforementioned predetermined scanning line, and thereafter repeats the aforementioned operation, to thereby write a potential of the same polarity to pixel groups corresponding to adjacent scanning lines for each two horizontal periods.

Alternatively, when the number of the aforementioned plural scanning lines is 4m lines, the aforementioned driver section supplies a pulse signal rising at a timing corresponding to the application period of the aforementioned positive polarity potential to a predetermined scanning line, supplies a pulse signal rising at a timing corresponding to the application period of the aforementioned negative polarity potential to a scanning line separated by m lines from the aforementioned predetermined scanning line, supplies a pulse signal rising at a timing corresponding to the application period of the aforementioned positive polarity potential to a scanning line separated by 2m lines from the aforementioned predetermined scanning line, and supplies a pulse signal rising at a timing corresponding to the application period of the aforementioned negative polarity potential to a scanning line separated by 3m lines from the aforementioned predetermined scanning line, and thereafter repeats the aforementioned operation, to thereby write a potential of the same polarity to pixel groups corresponding to adjacent scanning lines for each four horizontal periods.

The former method is an example of a situation in which one screen is divided into two regions of one positive potential application area and one negative potential application area, while the latter method is an example of a situation in which one screen is divided into four areas of two positive potential application areas and two negative potential application areas.

In the case where the number of divisions is small (in the case of two divisions), the time in which the adjacent pixels become the same polarity in one vertical period can be maximized. On the other hand, in the case where the number of divisions is large (in the case of four divisions), it becomes possible to make the bias of the data line potentials due to the display image become more uniform, so that cross-talk can be made even less conspicuous.

Preferably a frame memory is provided in the driver section.

According to this configuration, image data is temporarily stored by the frame memory, and then image data to be written to the pixel is read out to the pixels in accordance with a scanning sequence of the scanning lines, and is supplied to the data line.

In addition, the liquid crystal device of the present invention comprises plural pixels provided in an array inside an image display area, and a driver section which matrix-drives these pixels, wherein the aforementioned driver section divides one field data into plural consecutive field data, alternately writes in each one horizontal period while shifting a write commencing time within one vertical period, and at the same time, inverts the write polarity of the data between consecutive fields.

For example, the case is considered in which one field data is written as even numbers (2m) of field data. In this case, in the driver section, when writing starts for a certain field, for example, the writing for the next field is started at a timing which is shifted by ½ m vertical period in the picture signal. Then, in these fields, after one line of a certain field has been written, data is written to a line of the next field which exists at a position skipping one part (several scanning lines) of the scanning lines from this line, to thus effect drawing. At this time, the polarity of the data output to the data line is inverted for each one horizontal period, so that the polarity of data in one field can be made equal, and the polarity of the data between consecutive fields can be made different.

In this manner, with the present liquid crystal device, for the scanning line side, scanning is performed over all of the scanning lines back and forth, while skipping plural scanning lines. Moreover, when observed in any one vertical period, plural areas comprising positive potential application areas and negative potential application areas by corresponding to each field exist within the screen. That is to say, this configuration is one where the configuration of the aforementioned liquid crystal device is represented from a macroscopic viewpoint. Therefore, a similar effect to that mentioned above can be obtained. In other words, within each area, also while artificially performing surface inversion driving, driving generally similar to the conventional line inversion driving is carried out for the data line side. For this reason, a significant difference in the relationship of the timewise potential for between the pixel electrode and the data line at the pixel on the upper stage side and the pixel on the lower stage side of the screen, as observed when the data line side is face-inversion-driven, does not occur. Hence, non-uniformity of the display depending on the location on the screen can be avoided while suppressing cross-talk, Furthermore, different from the conventional technique "where one horizontal period is divided into a first period and a second period, and in the first period, a driving pulse is supplied to a scanning line, and at the same time, an image signal is supplied to a data line to thereby apply an image signal to each pixel electrode, while on the other hand, in the second period, an image signal having the polarity inverted to the previous polarity is supplied to the data line without supplying a driving pulse to the scanning line", as disclosed above, the majority of the one horizontal period is consumed in writing to the pixel. For this reason, problems such as insufficient writing do not occur.

Moreover, by driving in this manner, while moving the scanning lines at a timing synchronized with the picture signal, the two scanning lines are alternately allocated in each of the horizontal periods to set the writing in half the time with respect to the input picture signal. Therefore, the frequency of the writing scan can be made twice that of the picture signal.

In such a liquid crystal device, the configuration is preferably such that a memory is provided in the aforementioned driver section, and the aforementioned driver section, when writing one field data as consecutive first and second two field data, writes an image signal input from the outside as is, as a first field data, and while doing this, stores this image signal in the aforementioned memory to create a second field data which is delayed with respect to the aforementioned image signal, alternately writes the aforementioned first and second field data for each one horizontal period, and at the same time, inverts the polarity of the second field data with respect to the first field data. By having such a configuration, the memory capacity can be reduced, and material cost can be reduced.

For example, the case is considered in which the write start period for the second field data is delayed by ½ of a vertical period in the picture signal, with respect to one field data. In this example, while outputting to the data line, the image for the upper half of the screen by the image signal input from the outside, the image data for this upper half is also output to memory, and stored there. Then, while outputting to the data line, the image for the lower half of the screen by the image signal, the image data (that is, the image data for the upper half of the screen) for before ½ of a vertical period in the picture signal from the memory, is output to the data line. This data from the outside and from the memory is alternately output for each one horizontal period with respect to the data lines.

On the other hand, on the scanning line side, since the scanning lines for the upper stage side and the lower stage side of the screen are alternately selected for each one horizontal period, the image is alternately written between the upper stage side and the lower stage side on the screen. That is, in this configuration, while writing the image for each one line by the image signal from the outside, the image is also written by image data read out from the memory. Therefore, the image is written at essentially double speed (at two times the frequency of the image signal input from the outside). Normally, in the case of carrying out double speed driving, a memory with two field parts is necessary. However, with the present configuration, since half of the screen is written by outputting the image signal from the outside as is to the data line, the memory capacity need only be half the capacity of the whole display screen. For this reason, compared to the ordinary configuration, the memory capacity need only be ¼, and hence material cost can be significantly reduced. Furthermore, with this configuration, since double speed writing is carried out for the pixel, flicker is suppressed.

Moreover, when the aforementioned liquid crystal device is viewed from the configuration aspect, this liquid crystal device is characterized as follows. That is to say, the liquid crystal device of the present invention comprises plural data lines, plural scanning lines intersecting the data lines, plural pixels provided in an array inside an image display area, by corresponding to intersections of respective data lines and scanning lines, and a driver section which matrix-drives the aforementioned pixels, wherein the aforementioned driver section comprises a data driver which supplies an image signal for which the polarity is inverted into a positive polarity potential or a negative polarity potential for each one horizontal period, to each of the aforementioned plural data lines, and a scanning driver which sequentially shifts a gate-output pulse in synchrony with a clock signal which rises for each one horizontal period, and the aforementioned scanning driver outputs n gate-output pulses at a different timing within one vertical period in a picture signal, and alternately shifts each of the aforementioned gate-output pulses in synchrony with the aforementioned clock signals, and also allocates to respective scanning lines, either one of alternately rising m enable signals, to thereby control the output of the scanning signals to respective scanning lines. Here, n and m represent integers of 2 or more.

With this configuration, the n gate-output pulses in the one vertical period in the picture signal rise at separate scanning line positions within the image display area, and each is shifted from the upper stage side of the image display area towards the lower stage side thereof in synchrony with the clock signal. In addition, the scanning signal is output to a scanning line selected by an enable signal, from among the rising scanning lines for these gate-output pulses. As a result, it is possible to perform scanning in a manner where a part (several lines) of the scanning lines is skipped.

As a form where m is two, there can be given as an example, a configuration in which in the aforementioned scanning driver, two gate-output pulses are output at the same time to positions which are shifted by the position corresponding to ½ of a vertical period in the picture signal, either one of first and second two alternately rising enable signals is allocated to respective scanning lines at the shifted positions, and when the image display area is divided into first and second two display areas from an upper stage side along a scanning line array direction, allocates respective enable signals to plural scanning lines arranged in either one of respective display areas, and the aforementioned scanning signals are alternately output to the aforementioned first and second display areas by corresponding to the rising positions of the respective enable signals.

With this configuration, the two gate-output pulses rise at the same time at a position shifted by ½ of the screen in the picture signal, and each is shifted from the upper stage side of the image display area towards the lower side in synchrony with the clock signal. Then, the scanning signal is output to a scanning line selected by an enable signal, from among the rising scanning lines for these gate-output pulses. At this time, the first enable signal is allocated to the first display area and the second enable signal is allocated to the second display area. For this reason, the scanning line is alternately selected as the upper stage side scanning line and the lower side scanning line of the image display area. As a result, scanning can be performed over all scanning lines while skipping the scanning lines of the ½ screen part, going back and forth to the upper stage side and the lower side of the image display area.

As a form where m is four, there can be given as an example, a configuration in which in the aforementioned scanning driver, four gate-output pulses are sequentially output at the same time to positions which are shifted by the position corresponding to ¼ of a vertical period in the picture signal, and any one of first through fourth four alternately rising enable signals is allocated to respective scanning lines, and when the image display area is divided into first through fourth four display areas from an upper stage side along a scanning line array direction, respective enable signals are allocated to plural scanning lines arranged in any one of the respective display areas, and the aforementioned scanning signals are alternately output to the aforementioned first through fourth display areas by corresponding to the rising positions of the respective enable signals.

With this configuration, the four gate-output pulses rise at the same time at a position shifted by ¼ of the screen in the picture signal, and each is shifted from the upper stage side of the image display area towards the lower side in synchrony with the clock signal. The scanning signal is output to a scanning line selected by an enable signal, from among the rising scanning lines for these gate-output pulses. At this time, the first enable signal is allocated to the first display area, the second enable signal is allocated to the second display area, the third enable signal is allocated to the third display area, and the fourth enable signal is allocated to the fourth display area. For this reason, the scanning line inside the first, second, third, and fourth display areas is alternately selected. As a result, scanning can be performed over all scanning lines while skipping the scanning lines of the ¼ screen part, going back and forth to each display area.

Moreover, as another form where m is two, there can be given as an example, a configuration in which in the aforementioned scanning driver, two gate-output pulses are output at the same time to positions which are shifted by the position corresponding to ½ of a vertical period in the picture signal, and either one of first and second two alternately rising enable signals is allocated to respective scanning lines, the aforementioned first and second enable signals are allocated to the scanning lines arranged at each of odd numbers and even numbers of lines from the uppermost side of the image display area, and when the image display area is divided into first and second two display areas from an upper stage side along a scanning line array direction, the aforementioned scanning signal is alternately output to the aforementioned first and second display areas by corresponding to the rising positions of the respective enable signals.

With this configuration, the two gate-output pulses in the one vertical period in the picture signal rise at a position shifted by ½ screen parts, and each is shifted from the upper stage side of the image display area towards the lower stage side in synchrony with the clock signal.

For example, the two gate-output pulses can rise at the $k^{th}$ and $s+k^{th}$ (wherein s is an odd number) scanning line positions from the uppermost side. At this time, the scanning signal is output to a scanning line selected by an enable signal, from among the rising scanning lines for these gate-output pulses. At this time, the first enable signal is allocated to the scanning line of the odd number count from the uppermost side of the image display area, and the second enable signal is allocated to the scanning line of the even number count therefrom. For this reason, by making the first and second enable signals rise in sequence of for example, first, first, second, second, first, first, and so on, while being shifted out of phase with the shift clock of the scanning driver, the scanning lines on the upper stage side and lower stage side of the screen are alternately selected in the sequence of $1^{st}$, $s+1^{st}$, $2^{nd}$, $s+2^{nd}$, $3^{rd}$ $s+3^{rd}$, and so on, from the uppermost side of the image display area.

Moreover, in these configurations, preferably a memory is provided in the aforementioned driver section, and while an image signal input from the outside is being supplied to the aforementioned data driver, this is also stored in the aforementioned memory, and the aforementioned data driver alternately supplies in each of the one horizontal periods, an image signal input from the outside, and image data read out from the aforementioned memory, and also inverts the polarity of the image data read out from the aforementioned memory with respect to the aforementioned image signal, to thereby supply an image signal for which the polarity is inverted into the positive polarity potential or the negative polarity potential for each one horizontal period, to each of the aforementioned plural data lines. By having such a configuration, the memory capacity can be reduced, and material cost can be reduced.

That is, in this configuration, while writing an image for each one line by the image signal from the outside, the image is also written by image data read out from the memory. For this reason, the image is written at substantially double speed (at two times the frequency of the image signal input from the outside). Normally, in the case of carrying out double speed driving, a memory with two screen parts (two field parts) is necessary. On the other hand, with the present configuration, since half of the screen is written by outputting the image signal input from the outside as is to the data line, the memory capacity need be only half the capacity of the whole display screen. For this reason, compared to the ordinary configuration, the memory capacity need only be ¼, and hence material cost can be significantly reduced. In addition, with this configuration, since double speed writing is carried out for the pixel, flicker is suppressed.

A drive method for a liquid crystal device of the present invention is a drive method for a liquid crystal device which comprises plural data lines, plural scanning lines intersecting the data lines, and pixels connected to the aforementioned data lines and the aforementioned scanning lines, comprising the steps of supplying to each of the aforementioned plural data lines an image signal for which the polarity is inverted into a positive polarity potential or a negative polarity potential, for each unit period, and at the same time, supplying for each one horizontal period plural pulse signals which each rise at a different timing, to each of the aforementioned plural scanning lines while skipping one part of the aforementioned plural scanning lines; and driving such that plural scanning lines to which is supplied a pulse signal rising at a timing corresponding to an application period of a positive polarity potential among the aforementioned image signals are adjacent to each other, and plural scanning lines to which is supplied a pulse signal rising at a timing corresponding to an application period of a negative polarity potential among the aforementioned image signals are adjacent to each other, in any one horizontal period.

According to the drive method for the liquid crystal device of the present invention, similar actions and effects to the liquid crystal device of the aforementioned invention can be obtained.

That is, for each one arbitrary horizontal period, the plural scanning lines to which is supplied the pulse signal rising at a timing corresponding to the application period of the positive polarity potential are adjacent to each other, and the plural scanning lines to which is supplied the pulse signal rising at a time corresponding to the application period of the negative polarity potential are adjacent to each other. For this reason, a positive polarity application area and a negative polarity application area having a width of a certain extent inside the screen are inverted at a predetermined period, so that surface inversion driving is carried out for each area. In the case of the present invention, consequently, while also performing surface inversion driving for each area, an operation similar to the conventional line reversal driving is performed for the data line side. For this reason, non-uniformity of the display depending on the location on the screen can be avoided while suppressing cross-talk. Furthermore, since the majority of the one horizontal period is consumed in writing to the pixel, problems such as insufficient writing do not occur.

Moreover, it is preferable that, in one vertical period, an application time of positive polarity potential and an application time of negative polarity potential of the image signal supplied to each data line be substantially equal. Furthermore, it is preferable that, in one vertical period, a potential of the same polarity be written for a time of not less than 50% of the one vertical period, to two pixel groups corresponding to two adjacent scanning lines. In addition, it is preferable that the unit period in which the polarity of the aforementioned image signal is inverted be made one horizontal period.

As a specific scanning sequence, for example, when the number of the aforementioned plural scanning lines is 2m lines, a pulse signal rising at a timing corresponding to the application period of the aforementioned positive polarity potential can be supplied to a predetermined scanning line, and then a pulse signal rising at a timing corresponding to the application period of the aforementioned negative polarity potential can be supplied to a scanning line separated by m lines from the predetermined scanning line described above, and thereafter the aforementioned operation can be repeated, to thereby write a potential of the same polarity to pixel groups corresponding to adjacent scanning lines for each two horizontal periods.

Alternatively, when the number of the aforementioned plural scanning lines is 4m lines, a pulse signal rising at a timing corresponding to the application period of the aforementioned positive polarity potential can be supplied to a predetermined scanning line, a pulse signal rising at a timing corresponding to the application period of the aforementioned negative polarity potential can be supplied to a scanning line separated by m lines from the aforementioned predetermined scanning line, a pulse signal rising at a timing corresponding to the application period of the aforementioned positive polarity potential can be supplied to a scanning line separated by 2m lines from the aforementioned predetermined scanning line, and a pulse signal rising at a timing corresponding to the application period of the aforementioned negative polarity potential can be supplied to a scanning line separated by 3m lines from the aforementioned predetermined scanning line, and thereafter the aforementioned operation can be repeated, to thereby write a potential of the same polarity to pixel groups corresponding to adjacent scanning lines for each four horizontal periods.

In addition, it is preferable that the write scanning frequency be made a frequency of not less than 100 Hz. As a result, flicker attributable to polarity differences in writing to the pixel can be made inconspicuous.

In addition, a drive method for a liquid crystal device of the present invention is a drive method for a liquid crystal device in which plural pixels are arranged in matrix form inside an image display area, comprising the steps of dividing one field data into plural consecutive field data, at the same time, alternately writing the field data to each one horizontal period while shifting a write commencing time within one vertical period in a picture signal, and at the same time, inverting the write polarity of the data between consecutive fields.

With such a drive method, cross-talk is suppressed by performing line inversion driving substantially the same as heretofore, with respect to the data line, and on the other hand, by forming a positive polarity application area and a negative polarity application area having a width of a certain extent inside the screen, non-uniformity of the display depending on the location on the screen can be avoided. In addition, since the majority of the one horizontal period is consumed in writing to the pixel, problems such as insufficient writing do not occur.

In addition, in such a liquid crystal device, a memory may be provided, and driving performed using an image signal input from the outside and using image data read out from the memory. That is, the drive method for a liquid crystal device of the present invention is a drive method for a liquid crystal device which comprises plural pixels arranged in matrix form in an image display area, and a memory, comprising the steps of: writing the image signal input from the outside as is, as predetermined field data, when one field data is written as consecutive first and second two field data, while doing this storing this image signal in the aforementioned memory to create a second field data which is delayed with respect to the aforementioned image signal, alternately writing the aforementioned first and second field data for each one horizontal period, and at the same time, reversing the polarity of the second field data with respect to the first field data.

By means of this drive method also, non-uniformity of the display depending on the location on the screen can be avoided while suppressing cross-talk. Furthermore, with the present drive method, by dividing one frame data into plural field data, this is driven at substantially more than double speed, and hence flicker can be suppressed. Normally, in the case in which the driving at double speed or the like is performed, memory capacity for two fields is necessary. However, with the present method, since one part of the screen is written by outputting the image signal from the outside as is to the data line, the necessary memory capacity can be less than for one field. For example, in the case in which one frame data is separated into two field data, driving is performed at double speed, and the memory need be only a ½ field. For this reason, material cost can be significantly reduced, thus being advantageous costwise.

A projection type display apparatus of the present invention is a projection type display apparatus comprising an illumination device, a light modulation device which modulates light emerged from the aforementioned illumination device, and a projection device which projects light modulated by the aforementioned light modulation device, wherein the aforementioned liquid crystal device of the present invention described above is provided as the aforementioned light modulation device.

According to this configuration, by providing the aforementioned liquid crystal device of the present invention, a projection type display apparatus with superior display quality can be realized.

BRIEF DESCRIPTION OF THE SEVERAL VIEWS OF THE DRAWING

FIG. 10 is a diagram for explaining the movement of the screen of FIG. 1.

DETAILED DESCRIPTION OF THE INVENTION

First Embodiment

In the following, a first embodiment of the present invention is described with reference to FIG. 1 through FIG. 10.

In the present embodiment, a description is given of an example of a liquid crystal light valve (liquid crystal device) used as a light modulation device for a projection type display apparatus.

Figure 1:
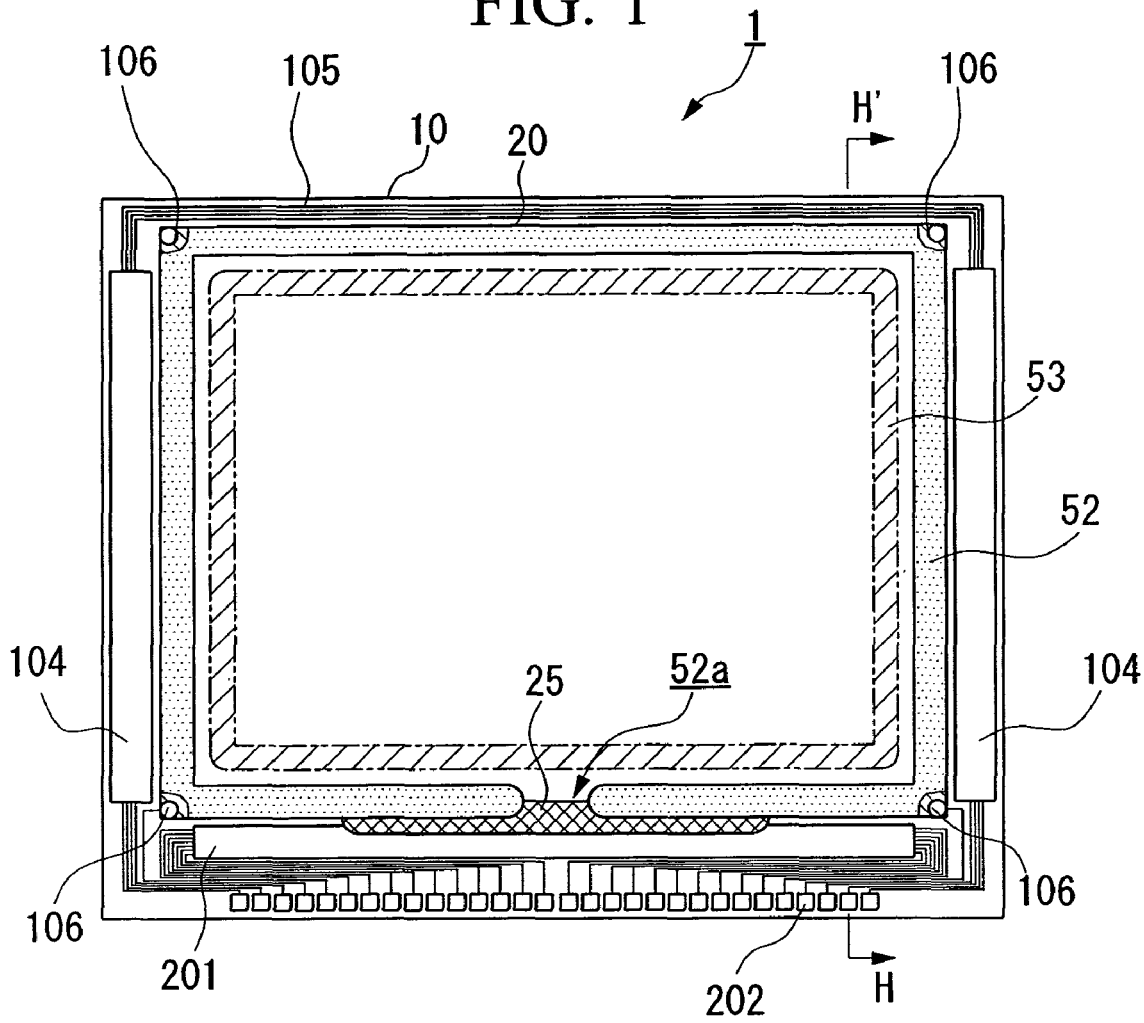
FIG. 1 is a plan view showing a schematic configuration of a liquid crystal light valve of a first embodiment of the present invention.
Figure 2:
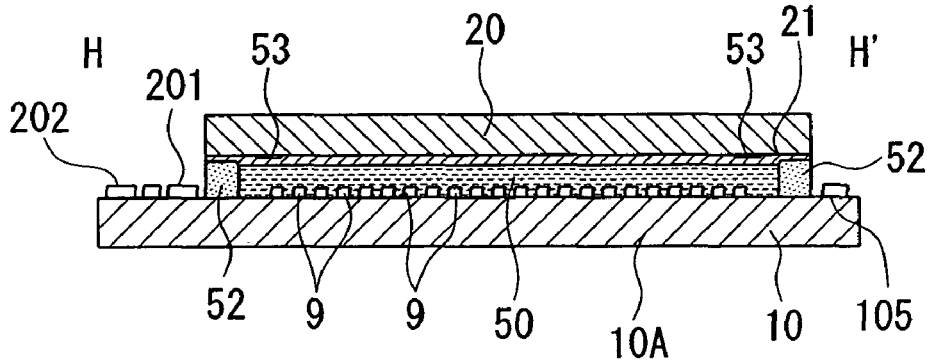
FIG. 2 is a sectional view along the line H-H' of FIG. 1.
Figure 3:
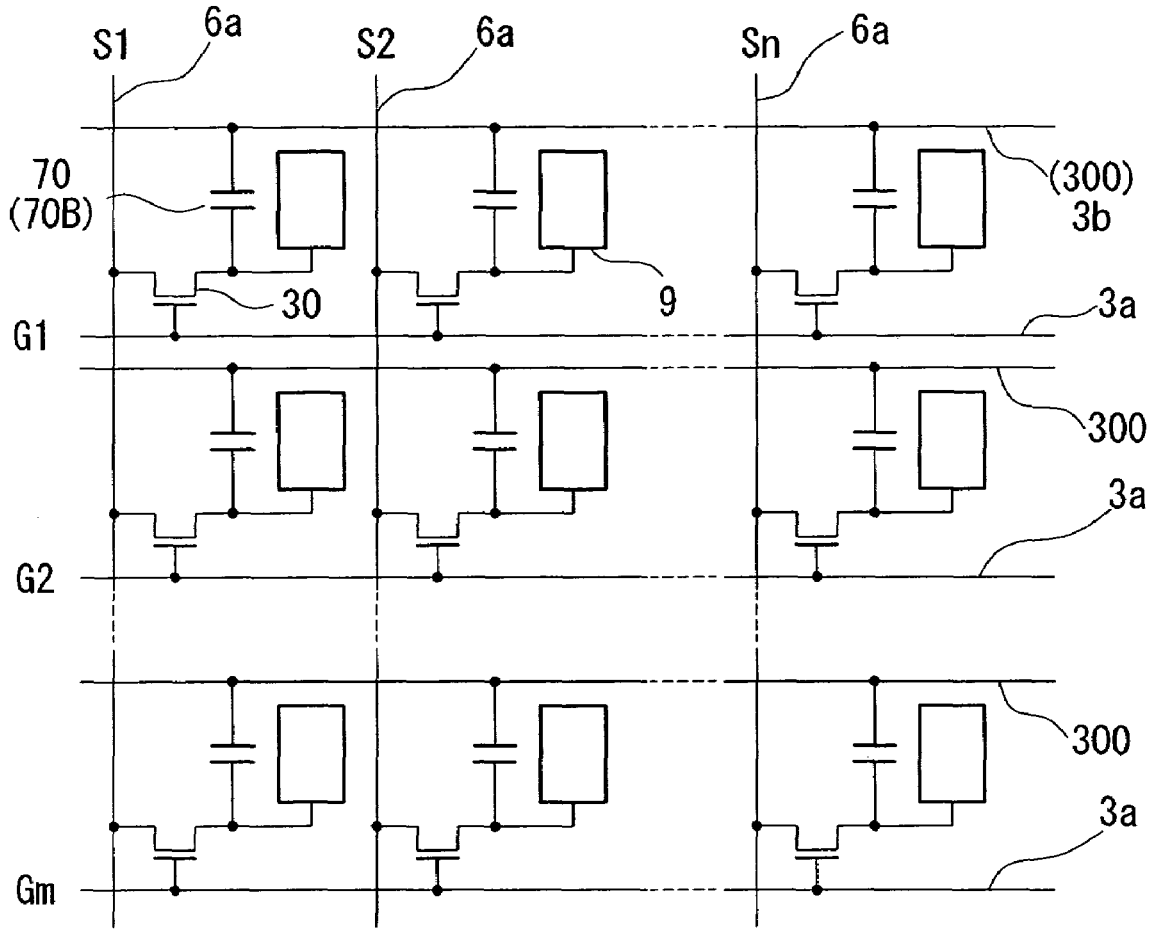
FIG. 3 is an equivalent circuit diagram of plural pixels formed in matrix form, which constitute the liquid crystal light valve of FIG. 1.
Figure 4:
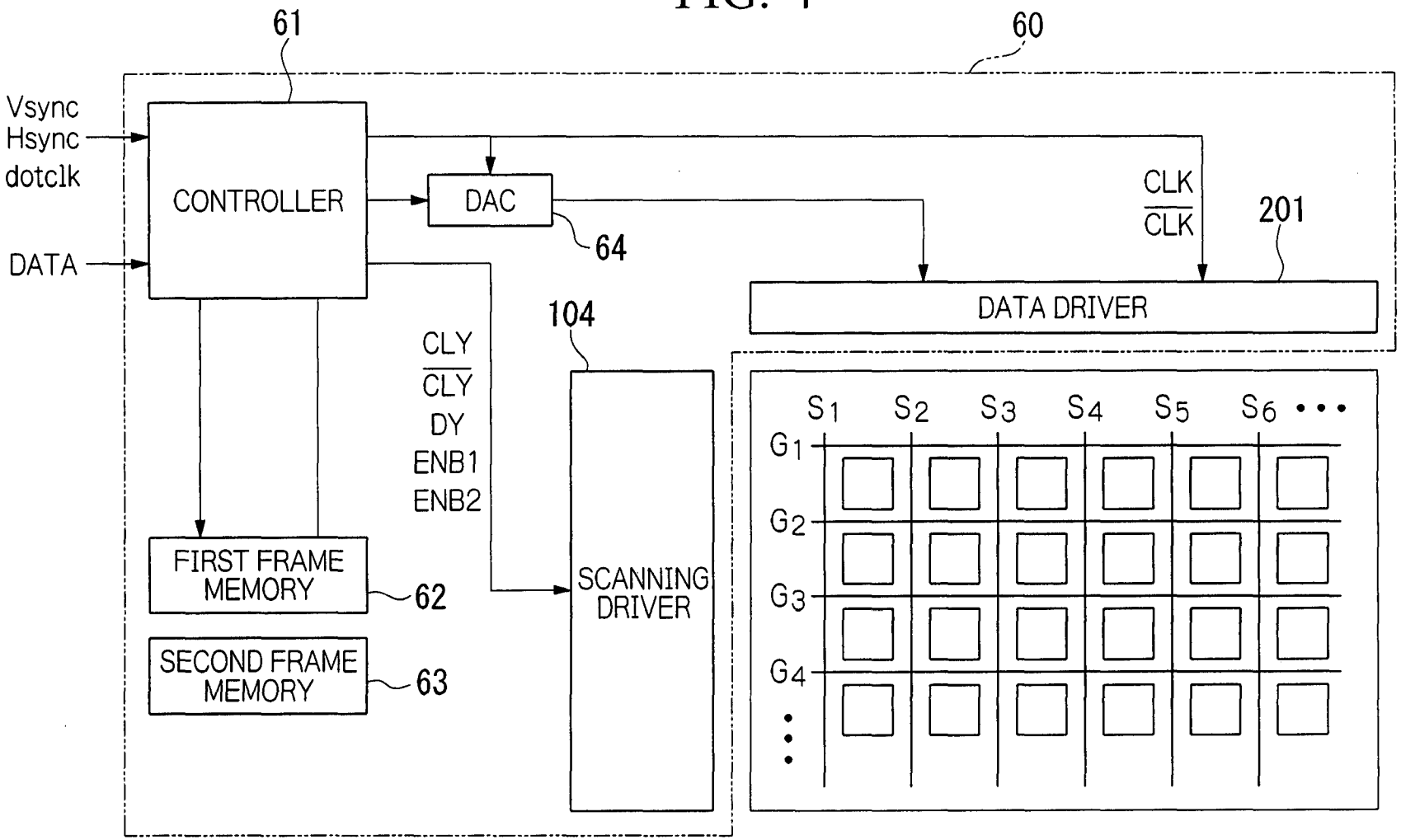
FIG. 4 is a block diagram including a driver section of the liquid crystal light valve of FIG. 1.
Figure 5:
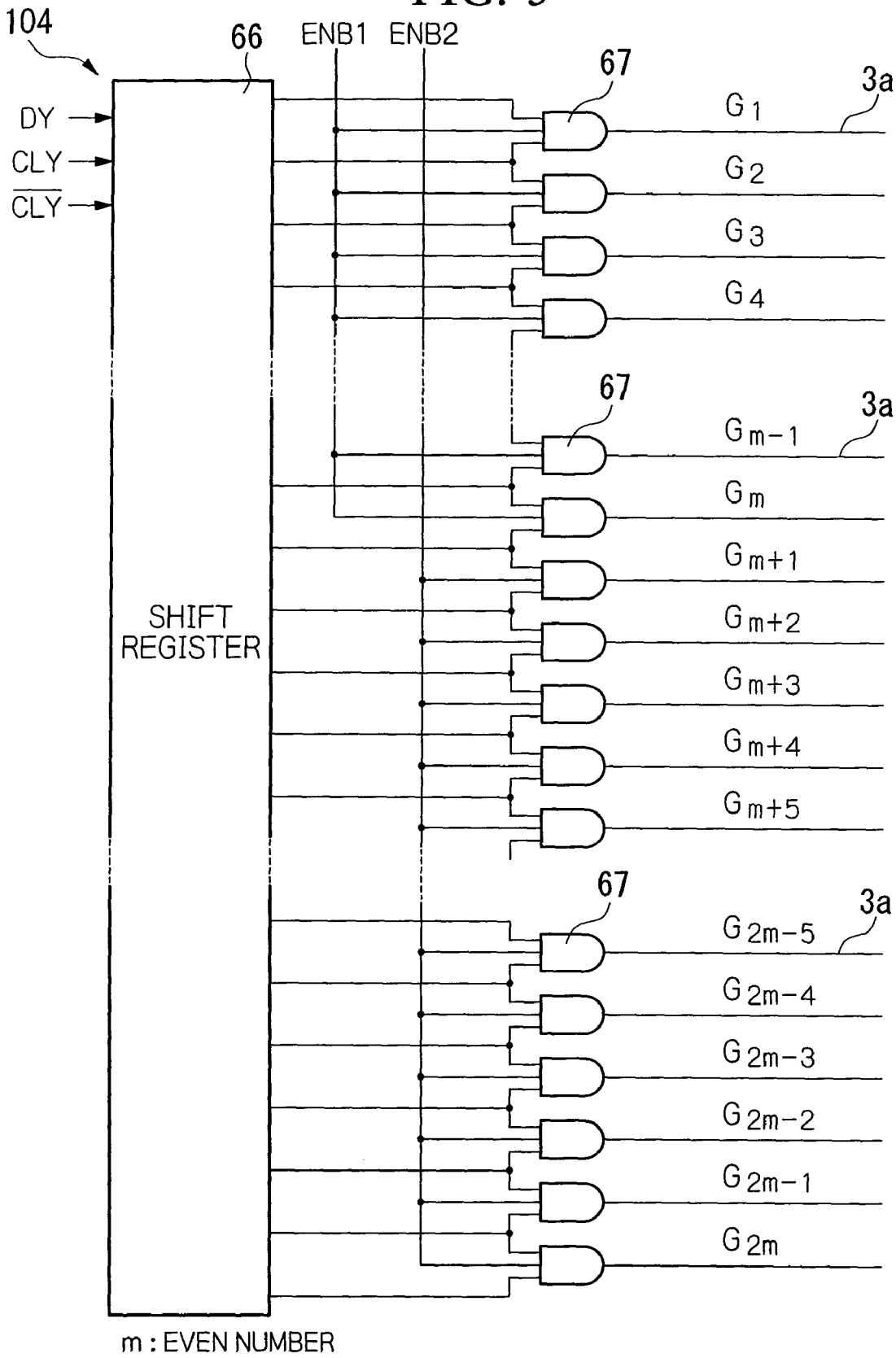
FIG. 5 is a circuit diagram showing a configuration of a scanning driver inside the driver section of FIG. 1.
Figure 6:
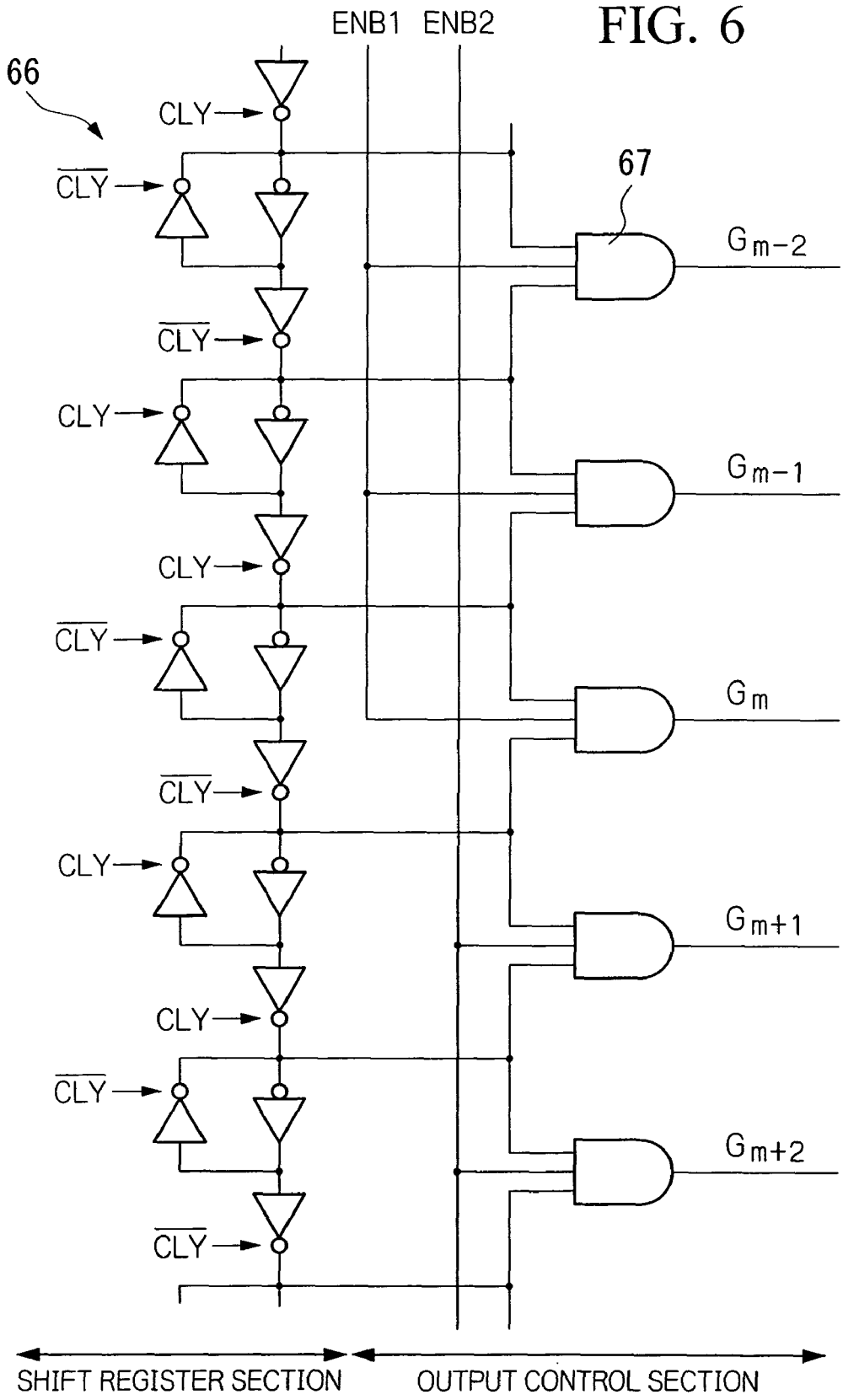
FIG. 6 is a detailed circuit diagram of the main part in FIG. 5.
Figure 7:
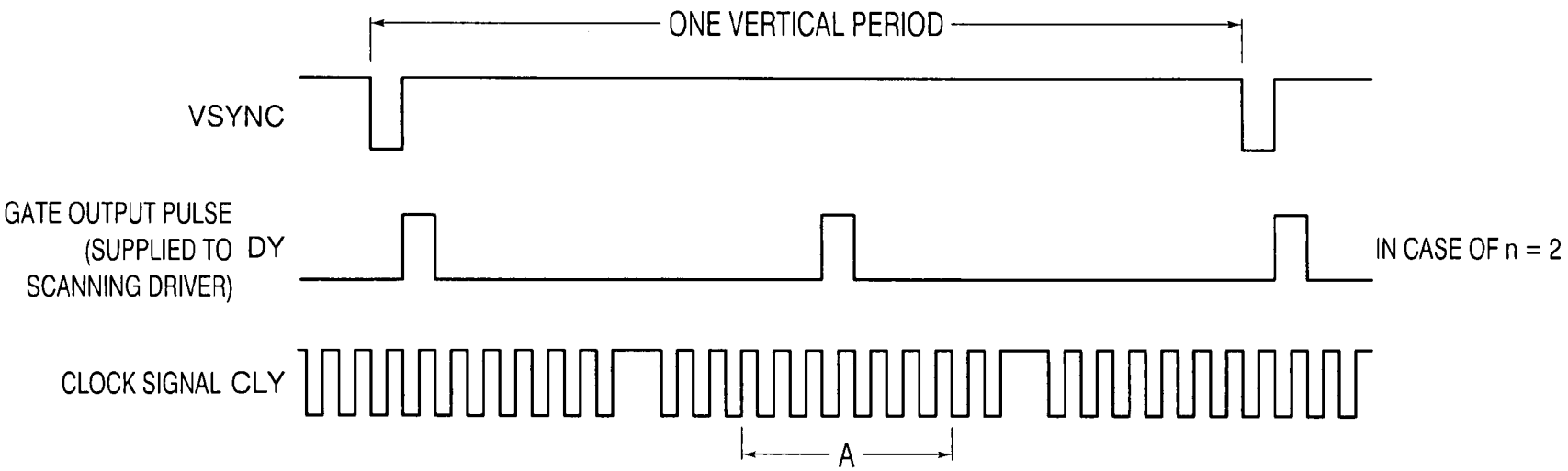
FIG. 7 is a timing chart for explaining the operation of the liquid crystal light valve of FIG. 1.
Figure 8:
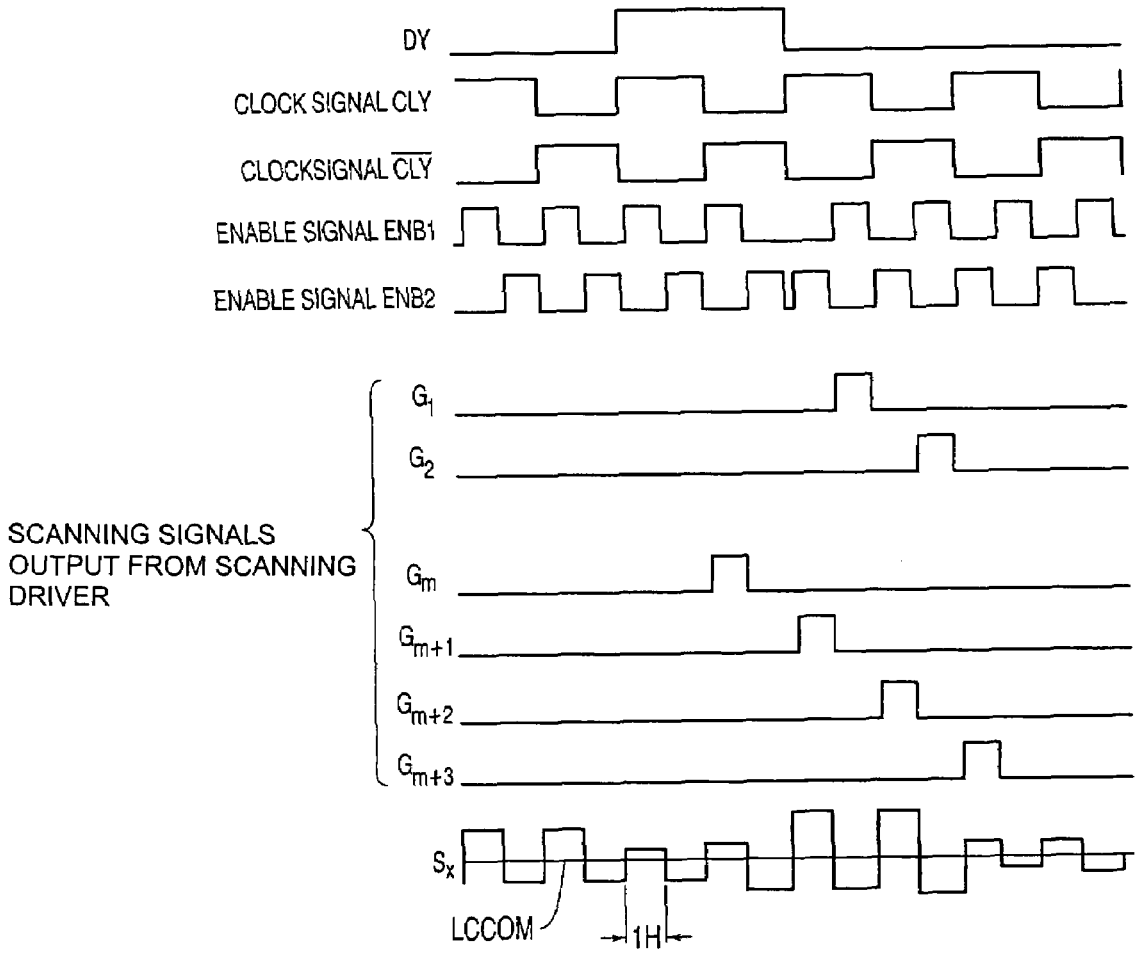
FIG. 8 is a timing chart illustrating a main part extracted from FIG. 7.
Figure 9:
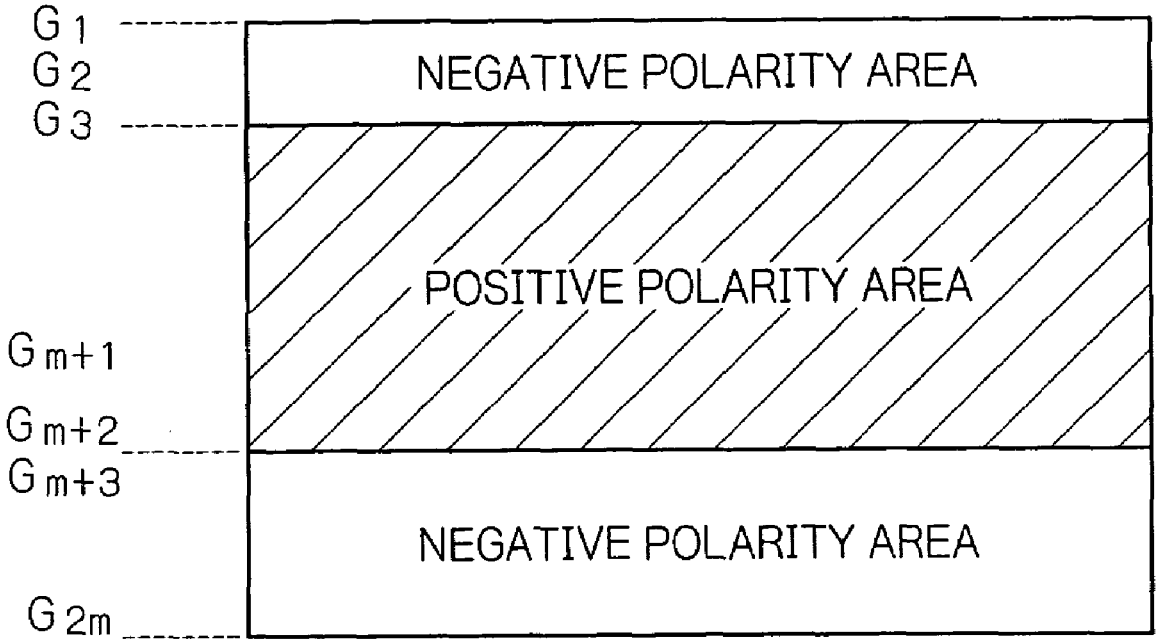
FIG. 9 is a diagram showing an image of a screen of the liquid crystal light valve of FIG. 1.

FIG. 1 is a schematic block diagram of a liquid crystal light valve of the present embodiment, FIG. 2 is a sectional view along the line H-H' of FIG. 1, FIG. 3 is an equivalent circuit diagram of plural pixels formed in matrix form, which constitute the liquid crystal light valve, FIG. 4 is a block diagram including a driver section, FIG. 5 is a circuit diagram showing a configuration of a scanning driver inside the driver section, FIG. 6 is a detailed circuit diagram of the main part in FIG. 5, FIG. 7 is a timing chart for explaining the operation of the liquid crystal light valve, FIG. 8 is a timing chart illustrating a main part extracted from FIG. 7, FIG. 9 is a diagram showing an image of a screen, and FIG. 10 is a diagram for explaining the movement of the screen. In the respective drawings, the scale for each layer and each material is different so that each layer and each material is visible in the drawing.

Overall Configuration of Liquid Crystal Light Valve

In the configuration of a liquid crystal light valve 1 of the present embodiment, as shown in FIG. 1 and FIG. 2, on a TFT (thin film transistor) array substrate 10, there is provided a sealing member 52 along the edge of a facing substrate 20, and inside thereof and parallel therewith is provided a shading film 53 as a picture frame. In the area on the outside of the sealing member 52, a data driver (data line driver) 201 and external circuit connecting terminals 202 are provided along one side of the TFT array substrate 10, and scanning drivers (scanning line drivers) 104 are provided along the two sides adjacent to the aforementioned one side.

In addition, on the remaining one side of the TFT array substrate 10, is provided plural wirings 105 for connecting between the scanning drivers 104 provided on both sides of the image display area. Moreover, in at least one part of a corner portion of the facing substrate 20, a vertical conducting member 106 is provided for electrically conducting between the TFT array substrate 10 and the facing substrate 20. In addition, as shown in FIG. 2, the facing substrate 20 having approximately the same outline as the sealing member 52 shown in FIG. 1, is fixed to the TFT array substrate 10 by the sealing member 52, and a liquid crystal layer 50 comprising a TN liquid crystal or the like is enclosed between the TFT array substrate 10 and the facing substrate 20. Furthermore, an opening portion 52*a* provided in the sealing member 52 shown in FIG. 1 is a liquid crystal filler hole, which is sealed by a sealant 25.

In FIG. 3, in each of plural pixels formed in matrix form constituting an image display area of the liquid crystal light valve 1 according to the present embodiment, is formed a pixel electrode 9 and a TFT 30 for switching control of the aforementioned pixel electrode 9, and a data line 6*a* to which image signals are supplied is electrically connected to a source area of the TFT 30. The liquid crystal light valve 1 of the present embodiment has n data lines 6*a* and 2m scanning lines 3*a* (both n and m are natural numbers). Image signals S1, S2, . . . Sn written to the data line 6*a* may be line-sequentially supplied in this order, or alternatively, may be supplied to each group for plural data lines 6*a* adjacent each other.

In addition, a scanning line 3*a* is electrically connected to the gate of each TFT 30, and the configuration is such that scanning signals $G_1$, $G_2$, . . . $G_{2m}$ are applied pulsewise to each of the scanning lines 3*a* at a predetermined timing, while skipping as described later. The pixel electrode 9 is electrically connected to the drain of the TFT 30, and by switching on the TFT 30 being a switching element, for a fixed period, the image signals S1, S2, . . . Sn supplied from the data line 6*a* are written at a predetermined timing. The image signals S1, S2, . . . Sn of a predetermined level which are written to the liquid crystal via the pixel electrode 9, are held for a fixed period between the pixel electrode and a common electrode formed in the facing substrate 20. Here in order to prevent leakage of the held image signals, a storage capacitor 70 is provided in parallel with the liquid crystal capacitor formed between the pixel electrode 9 and the common electrode.

The driver section 60 of the liquid crystal light valve 1 of the present embodiment, in addition to the aforementioned data driver 201 and scanning driver 104, comprises, as shown in FIG. 4, a controller 61, frame memories of two screen portions, namely a first frame memory 62 and a second frame memory 63, a DA converter 64, and the like. One of the first frame memory 62 and the second frame memory 63 is for temporarily storing a picture of one frame input from the outside, while the other is used for display, and these roles are alternated for each frame. The controller 61, to which are input a vertical synchronization signal Vsync, a horizontal synchronization signal Hsync, a dot clock signal dotclk, and an image signal DATA, performs control of the first frame memory 62 and the second frame memory 63, and reads out from the frame memory of data corresponding to the scanning line 3*a* to be written. The DA converter 64 digital-to-analog-converts the data read out from the frame memory and supplies the data to the data driver 201.

The configuration of the scanning driver 104, as shown in FIG. 5, has a shift register 66 to which are respectively input from the controller 61, a gate-output pulse DY, a clock signal CLY, and an inversion clock signal CLY', and 2m AND circuits 67 to which is input the output from the shift register 66. The 2m scanning lines 3*a* are divided into two blocks with the $m^{th}$ and the $m+1^{th}$ of the screen central portion as a boundary, and either one of two enable signals is connected to each output from the shift register 66. That is, the configuration is such that to the AND circuits 67 corresponding to scanning lines $G_1$ to $G_m$ are input the output from the shift register 66 and an enable signal ENB 1, and to the AND circuits 67 corresponding to the scanning lines $G_{m+1}$ to $G_{2m}$ are input the output from the shift register 66 and an enable signal ENB 2. An illustration for the screen central portion including the internal configuration of the shift register 66 is shown in FIG. 6.

Operation of the Liquid Crystal Light Valve

The operation of the driver section 60 of the aforementioned configuration is described using FIG. 7 and FIG. 8.

In the driver section 60, as shown in FIG. 7, a gate-output pulse DY is output twice during one vertical period of the input picture signal. The gate-output pulse DY shifts in the shift register 66 of the scanning driver 104 by means of a clock signal CLY having one pulse rising for each one horizontal period. Here, as shown in FIG. 8 (an enlargement of the place of symbol A in FIG. 7), when the gate-output pulse DY approaches the area to be controlled by a different enable signal of the screen central portion (more specifically the $G_{m+1}{}^{th}$ scanning line), the phases of the enable signal ENB 1 and the enable signal ENB 2 are reversed. Due to the above operation, the gate pulse is alternately output to two locations on the screen which are separated by m scanning lines. That is, the gate pulse is sequentially output so that skipping to a scanning line separated by m lines from a predetermined scanning line returns to the scanning line of the next stage of the aforementioned predetermined scanning line, and skipping to the scanning line separated by m lines from this scanning line again returns to the scanning line of this next stage (that is, in the sequence of scanning line $G_1$, scanning line $G_{m+1}$, scanning line $G_2$, scanning line $G_{m+2}$, scanning line $G_3$, and so on). Here, for the enable signals ENB 1 and ENB 2, the pulse width becomes approximately ½ of one horizontal period of the input picture signal. By outputting the gate-output pulse DY and the enable signals ENB 1 and ENB 2 as described above, the one horizontal period for the light valve becomes ½ of the input picture signal.

On the other hand, regarding the data signal Sx output from the data driver 201, the polarity is inverted into a positive polarity potential or a negative polarity potential for each one horizontal period, centered on the common potential LCCOM. Consequently, while on the data signal Sx side the polarity is being inverted for each one horizontal period, on the gate pulse side the gate pulse is alternately output to two locations of the screen which are separated by m scanning lines, in the aforementioned sequence. As a result, on the screen, as shown in FIG. 9, observing a certain one horizontal period, then for example the dots corresponding to scanning lines $G_3$ to $G_{m+2}$ become the area in which the data of positive polarity potential is written (hereinafter, simply referred to as the positive polarity area), and the dots corresponding to the scanning lines $G_1$ to $G_2$ and $G_{m+3}$ to $G_{2m}$ become the area in which the data of negative polarity potential is written (hereinafter, simply referred to as the negative polarity area), giving a condition as if inside the screen is divided into three areas, namely a positive polarity area and negative polarity areas where data of different polarities is written.

FIG. 9 shows an image of the screen seen for an instant of any one horizontal period, and FIG. 10 shows a condition of change in polarity on the screen after time passes. If the horizontal axis in FIG. 10 is time (units: 1 horizontal period), then for example in the first horizontal period a negative potential is written to the dot corresponding to scanning line $G_{2m}$, and in the next second horizontal period a positive potential is written to the dot corresponding to the scanning line $G_{m+1}$ which was written with a negative potential in the first horizontal period, and in the next third horizontal period a negative potential is written to the dot corresponding to scanning line $G_1$ which was written with a positive polarity potential in the first and second horizontal periods, and this writing operation is thereafter repeated. Consequently, the positive polarity area and the negative polarity area each move one line at a time for two horizontal periods, and when the scanning line is moved half of the screen, the positive polarity area and the negative polarity area are completely inverted. That is, rewriting of one screen has been performed. According to this method, the situation results where rewriting is performed twice by the scanning lines moving the whole screen. Consequently with respect to the input picture signal, one vertical period becomes ½.

In other words, in the present embodiment, one field data is divided into plural consecutive field data, while shifting the write start time within one vertical period, this is written alternately for each one horizontal period, and at the same time, the write polarity of the data between the consecutive fields is inverted. More specifically, one field data is divided into two field data, namely first and second field data having a different polarity to each other, and these field data are shifted by ½ of a vertical period and are overwritten. For this reason, for the scanning line side, scanning is performed over all of the scanning lines, going back and forth while skipping the scanning lines of one part (several lines). Therefore, observing any one vertical period, within the screen there exists plural areas comprising a positive potential application area and a negative potential application area by corresponding to the respective fields.

In the liquid crystal light valve of the present embodiment, by inverting in one vertical period the positive polarity area and the negative polarity area having a width of half of the screen in this manner, screen inversion driving is performed for each area. In one vertical period, between any one dot and an adjacent one dot, an inverted polarity potential is exhibited for only a time of 2/2m. However, the remaining major portion of the time of (2m−2)/2m has the same polarity potential. For this reason, disclination hardly occurs. On the other hand, on the data line 6*a* side, as shown in the signal wave form in FIG. 8, for the signal polarity, an operation similar to the conventional line inversion driving is performed. For this reason, there is no occurrence of a large difference in the relationship of the timewise potential of the pixel electrode and data lines at the upper stage side pixel and the lower stage side pixel of the screen, as observed when driven by the conventional surface reversal method, and non-uniformity of the display depending on the location on the screen can be avoided while suppressing cross-talk. Furthermore, different from the conventional technology, the majority of the one horizontal period is consumed in writing to the pixel. Therefore, problems such as insufficient writing also do not occur.

Moreover in the case of the present embodiment, since the scanning frequency becomes a frequency of not less than 100 Hz, being a frequency of twice the input picture signal frequency, flicker can be reliably suppressed.

Second Embodiment

In the following, a second embodiment of the present invention is described with reference to FIG. 11 and FIG. 12.

The basic configuration of a liquid crystal light valve (liquid crystal device) of the present embodiment is substantially the same as that of the first embodiment, and differs only in the point that surface inversion is performed by dividing the screen into four. That is to say, the present embodiment is a driving example where one field data is made four consecutive field data, namely first, second, third, and fourth field data, and the commencing time for writing is shifted by ¼ of a vertical period and overwritten. Within one field the write polarity of the data is the same, and in the adjacent fields (that is the first and second, the second and third, the third and fourth, and the fourth and first fields), the data-writing polarities are made different from each other.

Figure 11:
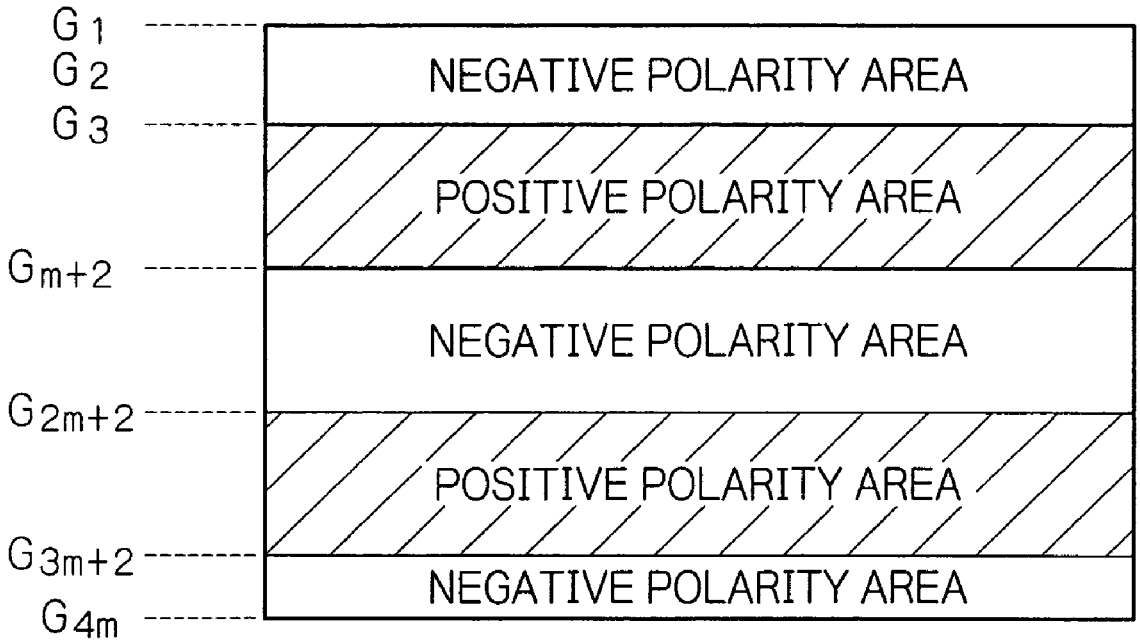
FIG. 11 is a diagram showing an image of a screen of a liquid crystal light valve of a second embodiment of the present invention.
Figure 12:
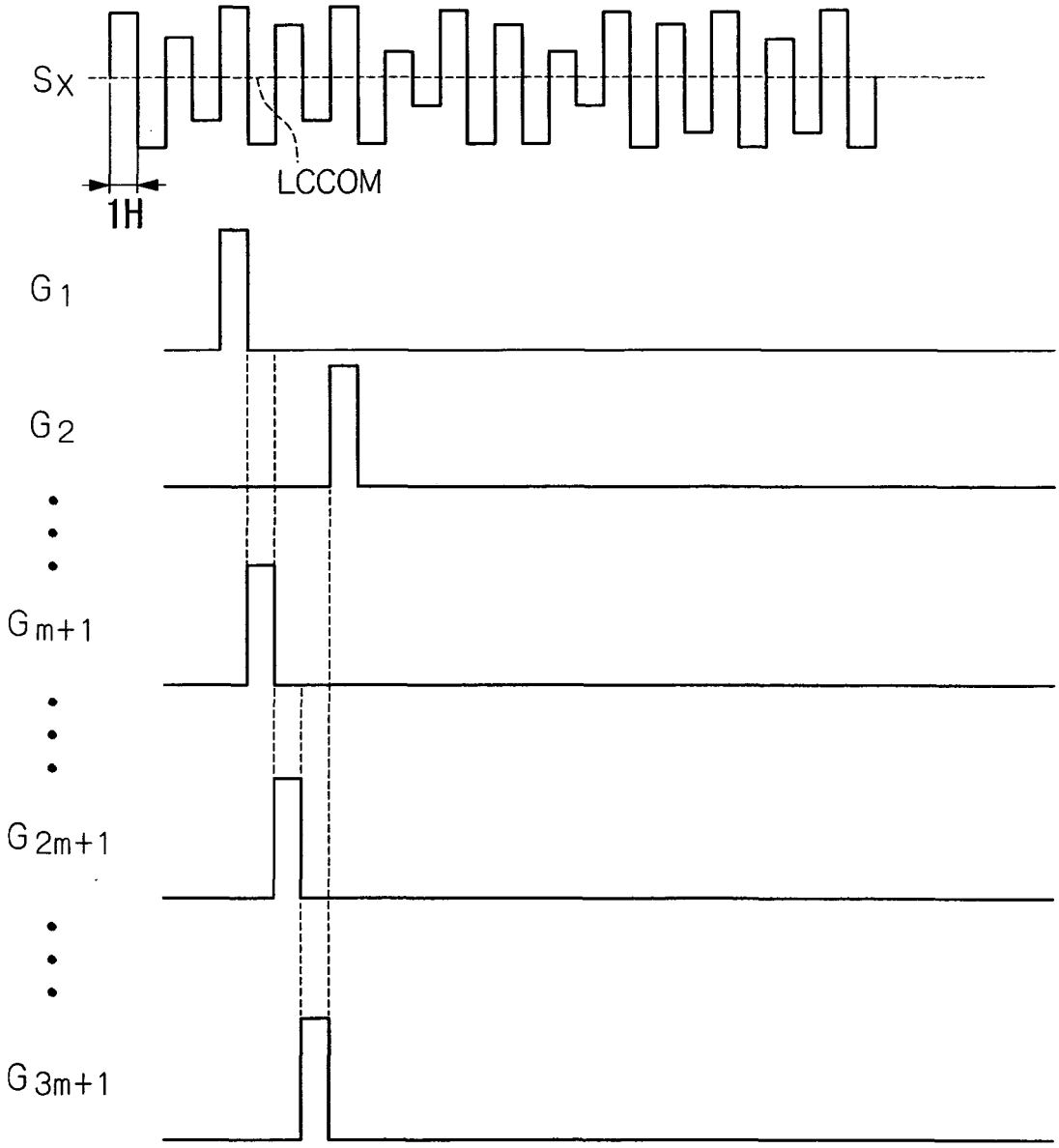
FIG. 12 is a timing chart for explaining the operation of the liquid crystal light valve.

FIG. 11 shows an image of a screen seen for an instant of any one horizontal period in the liquid crystal light valve of the present embodiment, and FIG. 12 is a timing chart for explaining the operation of the liquid crystal light valve. In the present embodiment, description related to the basic configuration of the liquid crystal light valve is omitted, and only the operation is described.

In the first embodiment, the number of scanning lines 3*a* was made 2m lines, however in the present embodiment, for convenience this is made 4m lines. Furthermore, in the scanning driver 104, these are divided into four fields, namely scanning lines $G_1$ to $G_m$, scanning lines $G_{m+1}$ to $G_{2m}$, scanning lines $G_{2m+1}$ to $G_{3m}$, and scanning lines $G_{3m+1}$ to $G_{4m}$, and four enable signals are used. Moreover, at this time, a gate-output pulse DY is output four times within one vertical period of the input picture signal.

In the case of the present embodiment, as shown in FIG. 12, the gate pulse is sequentially output to four locations on the screen which are separated by m scanning lines. That is to say, this is sequentially output skipping to a scanning line separated by m lines from a predetermined scanning line, then skipping to a scanning line separated by m lines from this scanning line (a scanning line separated by 2m lines from the first scanning line), and then skipping to a scanning line separated by m lines from this scanning line (a scanning line separated by 3m lines from the first scanning line), and then returning to the next stage scanning line of the aforementioned predetermined scanning line (that is, in the sequence of; scanning line $G_1$, scanning line $G_{m+1}$, scanning line $G_{2m+1}$, scanning line $G_{3m+1}$, scanning line $G_2$, scanning line $G_{m+2}$, scanning line $G_{2m+2}$, scanning line $G_{3m+2}$, and so on).

On the other hand, regarding the data signal Sx output from the data driver 201, the polarity is inverted into a positive polarity potential or a negative polarity potential for each one horizontal period, centered on the common potential LCCOM. Consequently, while on the data signal Sx side the polarity is being inverted for each one horizontal period, on the gate pulse side the gate pulse is sequentially output to four locations of the screen which are separated by m scanning lines at a time, in the aforementioned sequence. As a result, on the screen, as shown in FIG. 11, observing a certain one horizontal period, then for example the dots corresponding to the scanning lines $G_1$ to $G_2$ become the negative polarity area, the dots corresponding to the scanning lines $G_3$ to $G_{m+2}$ become the positive polarity area, the dots corresponding to the scanning lines $G_{m+3}$ to $G_{2m+2}$ become the negative polarity area, the dots corresponding to the scanning lines $G_{2+3}$ to $G_{3m+2}$ become the positive polarity area, and the dots corresponding to the scanning lines $G_{3m+3}$ to $G_{4m}$ become the negative polarity area, giving a condition as if the inside the screen were divided into five areas, namely positive polarity areas and negative polarity areas where data of different polarities is written.

This writing operation is repeated thereafter, and the positive polarity area and the negative polarity area are each moved one dot at a time for each four horizontal periods, so that ¼ of the screen is shifted in one vertical period. That is, the positive polarity areas and the negative polarity areas are completely inverted in one vertical period.

Also in the present embodiment, non-uniformity of the display depending on the location on the screen can be avoided while suppressing cross-talk, and problems such as insufficient writing do not occur, so that similar effects to those mentioned for the first embodiment can be obtained.

Third Embodiment

In the following, a third embodiment of the present invention is described with reference to FIG. 13.

The basic configuration of a liquid crystal light valve (liquid crystal device) of the present embodiment is substantially the same as that of the first and second embodiments, and only a scanning sequence of the scanning lines is different.

Figure 13:
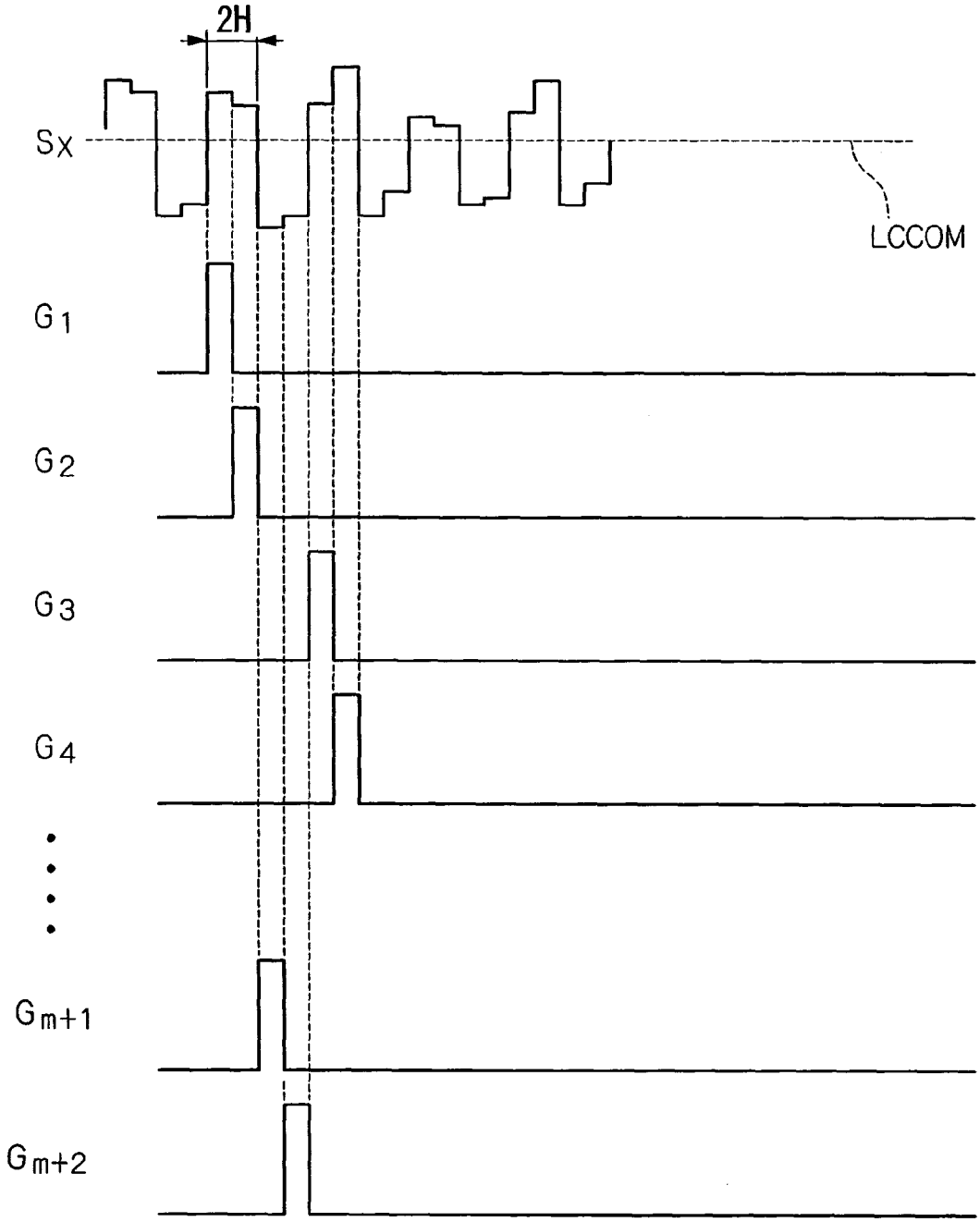
FIG. 13 is a timing chart for explaining the operation of a liquid crystal light valve of a third embodiment of the present invention.

FIG. 13 is a timing chart for explaining the operation of the liquid crystal light valve of the present embodiment. In the present embodiment, description related to the basic configuration of the liquid crystal light valve is omitted, and only the operation thereof is described.

In the present embodiment, the number of scanning lines 3*a* is made 2m lines. In the first and second embodiments, the polarity of the data signal Sx being the output from the data driver 201 is inverted into a positive polarity potential or a negative polarity potential for each one horizontal period, centered on the common potential LCCOM. On the other hand, in the present embodiment, as shown in FIG. 13, the polarity of the data signal Sx is inverted into a positive polarity potential or a negative polarity potential for each two horizontal periods, centered on the common potential LCCOM.

In addition, in the case of the present embodiment, the gate pulse is consecutively output to two adjacent scanning lines, after which m scanning lines are skipped, and the gate pulse is then consecutively output to the next two adjacent scanning lines. That is to say, the gate pulse is output to a predetermined scanning line, and is output to the scanning line adjacent to the predetermined scanning line, then skips to a scanning line separated by m lines from the predetermined scanning line described above and is output thereto, is output to the scanning line adjacent to this scanning line, is again returned to the scanning line adjacent to the scanning line which is adjacent to the aforementioned predetermined scanning line, is output thereto, and thereafter this sequence is repeated (that is, in the sequence of scanning line $G_1$, scanning line $G_2$, scanning line $G_{m+1}$, scanning line $G_{m+2}$, scanning line $G_3$, scanning line $G_4$, scanning line $G_{m+3}$, scanning line $G_{m+4}$, and so on).

In the case of the present embodiment, observing a certain one horizontal period, then on the screen, similar to the first embodiment as shown in FIG. 9, for example the dots corresponding to scanning lines $G_3$ to $G_{m+2}$ become the positive polarity area, the dots corresponding to the scanning lines $G_1$ to $G_2$ and $G_{m+3}$ to $G_{2m}$ become the negative polarity area, giving a condition as if the inside the screen were divided into three areas, namely a positive polarity area and negative polarity areas where data having different polarities is written. In addition, this writing operation is also repeated for the subsequent horizontal periods, and the positive polarity area and the negative polarity area are each moved one dot at a time for each two horizontal periods, so that half of the screen is moved in one vertical period. That is, the positive polarity areas and the negative polarity areas are completely inverted in one vertical period.

Also in the present embodiment, non-uniformity of the display depending on the location on the screen can be avoided while suppressing cross-talk, and problems such as insufficient writing do not occur, so that similar effects to those described for the first and second embodiments can be obtained.

Fourth Embodiment

In the following, a fourth embodiment of the present invention is described with reference to FIG. 15 through FIG. 18.

The basic configuration of a liquid crystal light valve (liquid crystal device) of the present embodiment is substantially the same as that of the first embodiment, and only the form of the memory and the scanning driver provided in the driver section is different.

Figure 15:
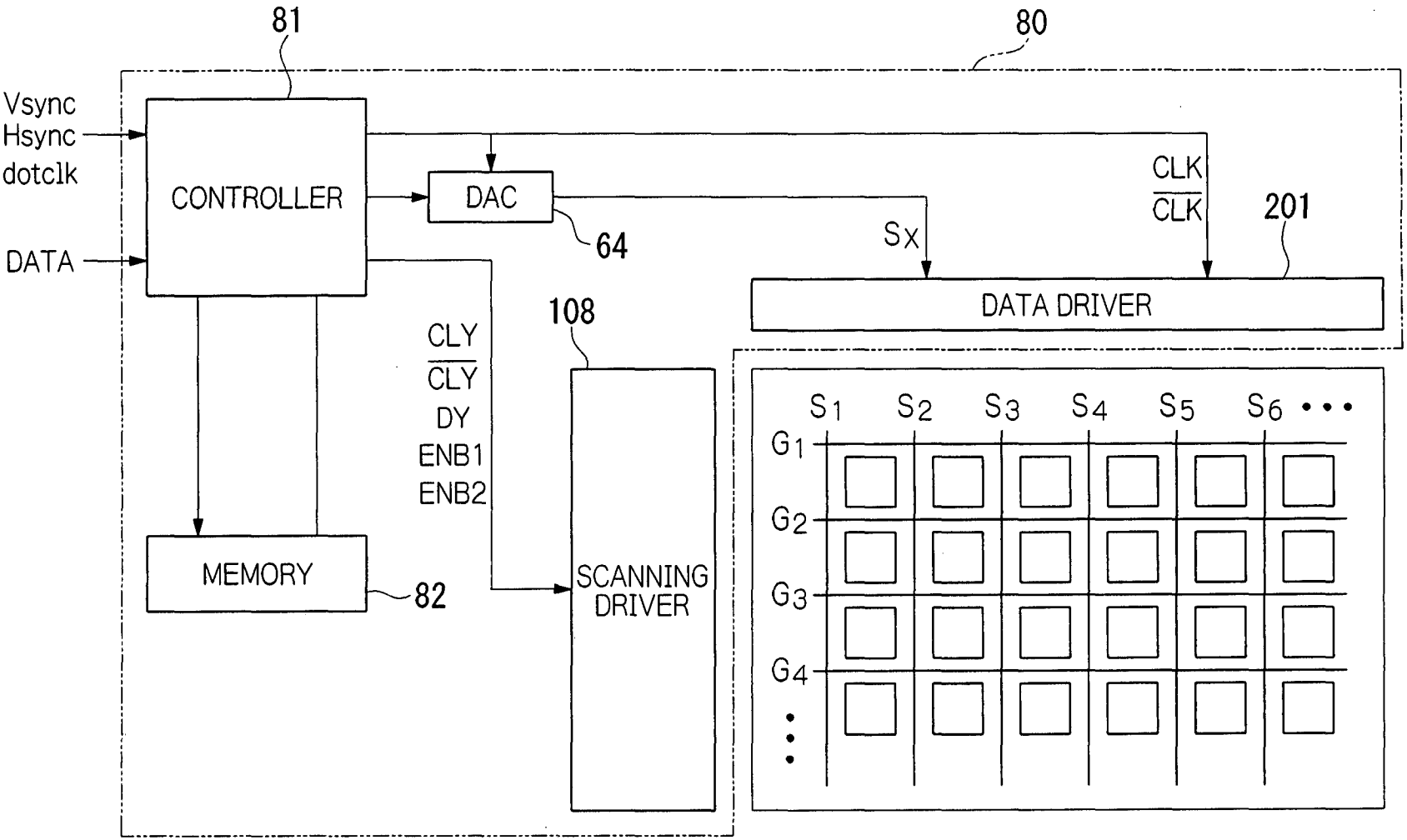
FIG. 15 is a block diagram including a driver section of a liquid crystal light valve of a fourth embodiment of the present invention.

A driver section 80 of a liquid crystal driver section 1 of the present embodiment, as shown in FIG. 15, comprises a data driver 201, a scanning driver 108, a controller 81, a memory 82, a DA converter 64, and the like. The memory 82 is for temporarily storing a picture of a half screen portion (½ field portion) which is input from the outside, and producing an image signal which is delayed by ½ of a vertical period from this stored data. The controller 81, to which are input a vertical synchronization signal Vsync, a horizontal synchronization signal Hsync, a dot clock signal dotclk, and an image signal DATA, performs control of the memory 82, and reads out from the memory of data corresponding to the write scanning line 3*a*. The DA converter 64 digital-to-analog-converts the image signal DATA input from the outside, and in parallel with this, the image data read out from the memory 82, and supplies them to the data driver 201. The image signal DATA from the outside and the image data read out from the memory 82 are alternately output for each one horizontal period with respect to the writing, to the DA converter 64.

Figure 16:
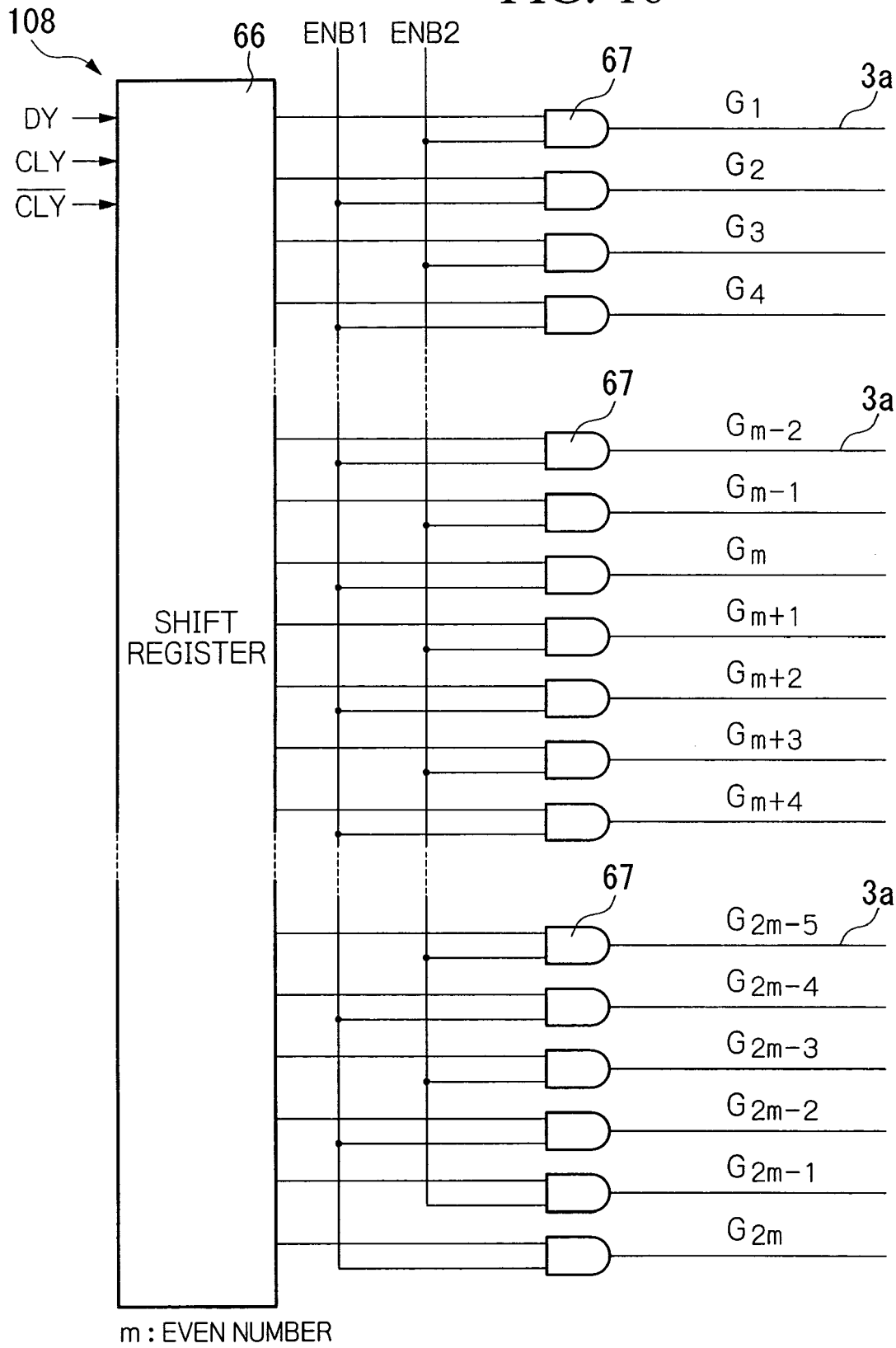
FIG. 16 is a circuit diagram showing the configuration of a scanning driver inside the driver section.
Figure 17:
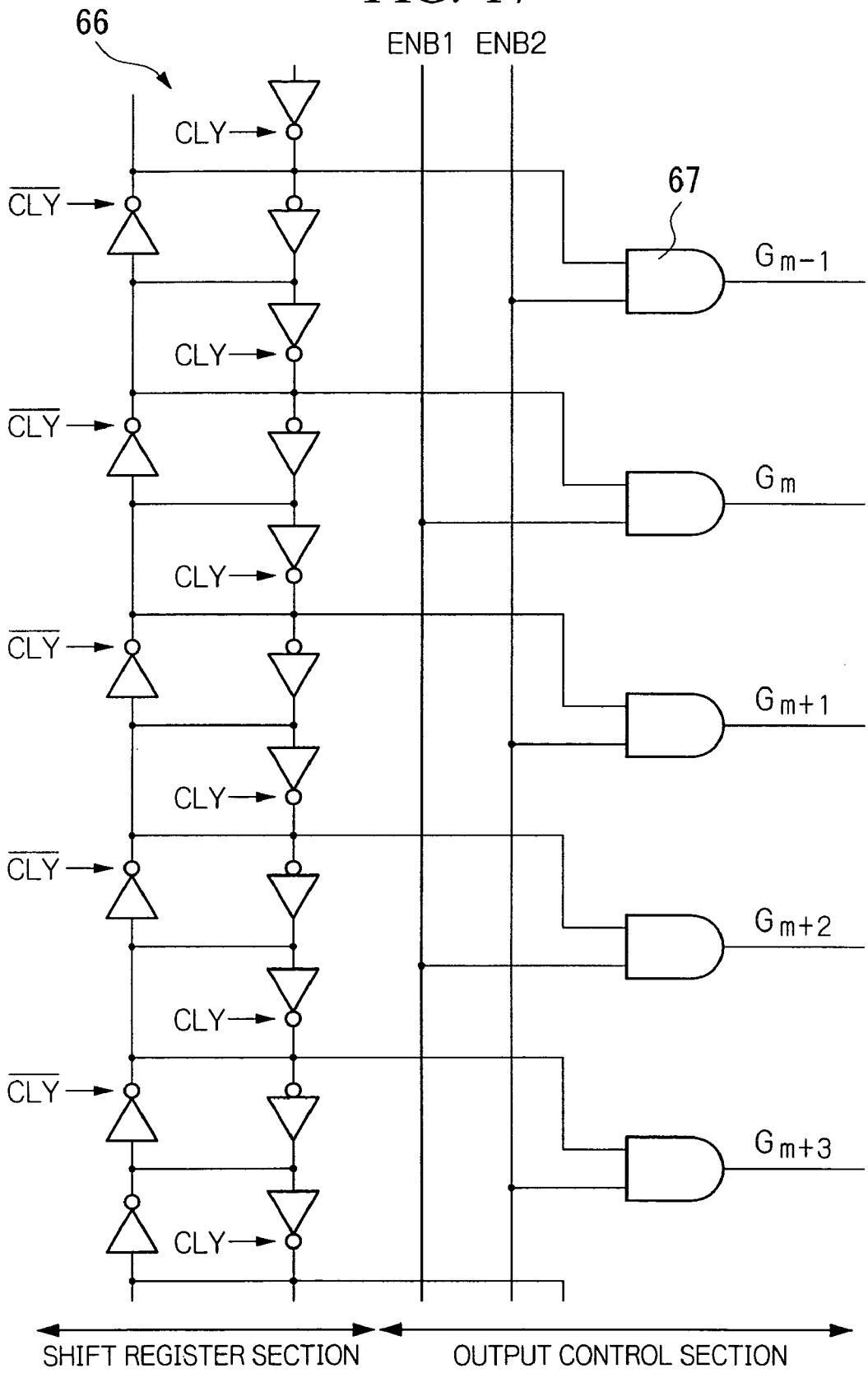
FIG. 17 is a detailed circuit diagram of the main part in FIG. 16.

The configuration of the scanning driver 108, as shown in FIG. 16, has a shift register 66 to which are respectively input from the controller 81, a gate-output pulse DY, a clock signal CLY, and an inversion clock signal CLY', and 2m AND circuits 67 to which is input the output from the shift register 66. The 2m scanning lines 3*a* are divided into two blocks, namely one arranged in odd numbers and one arranged in even numbers from the uppermost part of the image display area, and either one of two enable signals is sent to each output from the shift register 66. That is to say, the configuration is such that to the AND circuits 67 corresponding to even number scanning lines $G_2$, $G_4$, . . . $G_m$, $G_{m+2}$, . . . $G_{2m}$ are input the output from the shift register 66 and an enable signal ENB 1, and to the AND circuits 67 corresponding to the odd number scanning lines $G_1$, $G_3$, . . . $G_{m+1}$, $G_{m+3}$, . . . $G_{2m-1}$ are input the output from the shift register 66 and an enable signal ENB 2. An illustration for the screen central portion including the internal configuration of the shift register 66 is shown in FIG. 17.

Figure 18:
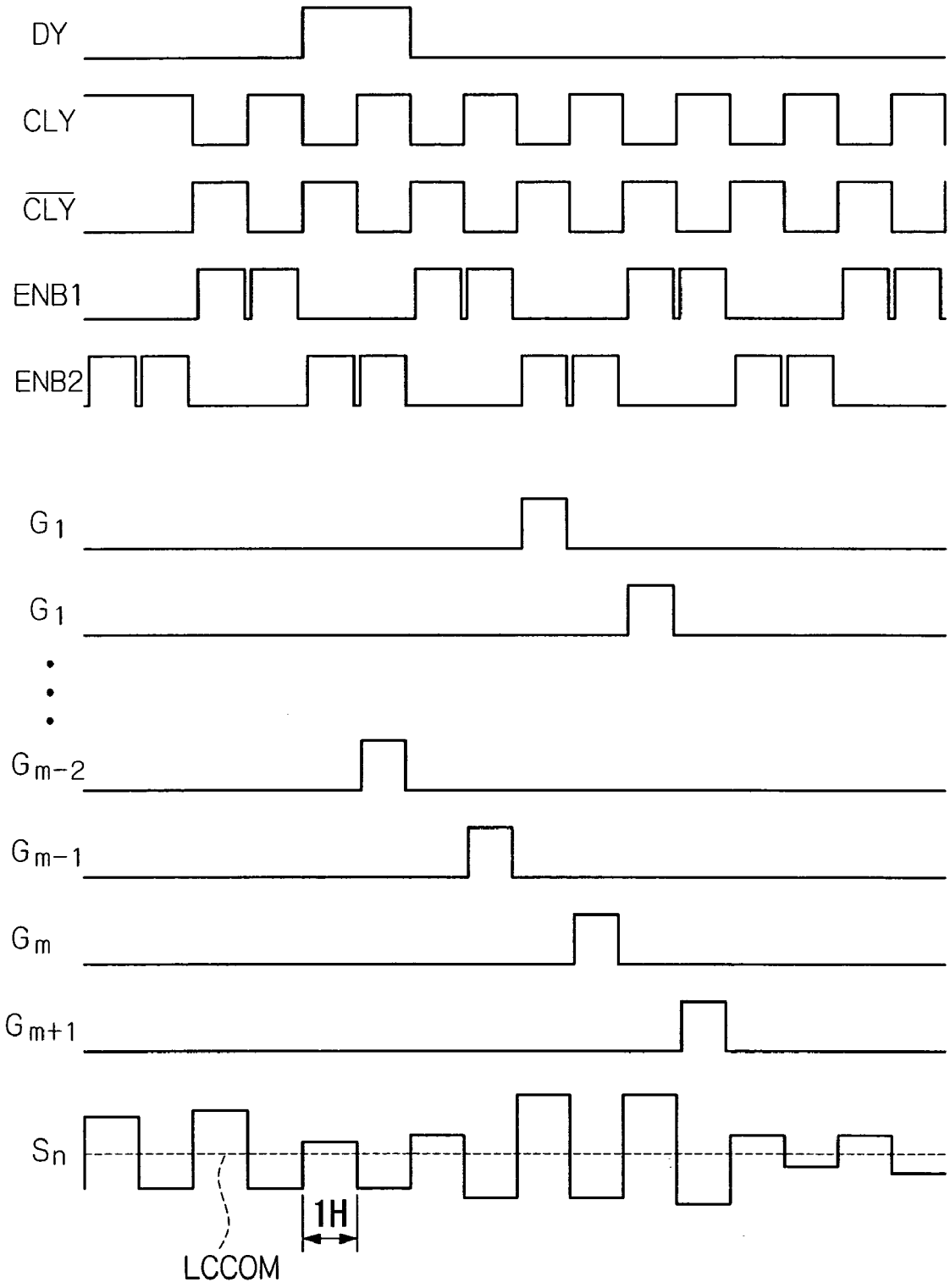
FIG. 18 is a timing chart for explaining the operation of the liquid crystal light valve.

The operation of the driver section 80 of the aforementioned configuration is described using FIG. 18.

In the driver section 80, the gate-output pulse DY is output twice during one vertical period of the picture signal. Here, the respective DYs are output at a timing separated by odd numbers of scanning lines. The gate-output pulse DY shifts in the shift register 66 of the scanning driver 108 by means of a clock signal CLY having one pulse rising for each one horizontal period of the picture signal. On the other hand, the enable signals ENB 1 and ENB 2 rise alternately for each two horizontal periods of the writing, in the sequence of ENB 1, ENB 1, ENB 2, ENB 2, ENB 1, ENB 1, ENB 2, ENB 2, and so on, and a scanning signal is output to the scanning lines corresponding to the rising positions of these enable signals. Here, since the two scanning lines are present at odd number separated locations in accordance with the output timing of the DY, then the outputs can be controlled by different enable signals. Due to the above operation, the gate pulse is alternately output to two locations on the screen separated by m scanning lines. That is to say, the gate pulse is sequentially output so that skipping to a scanning line separated by m lines from a predetermined scanning line returns to the scanning line of the next stage of the predetermined scanning line described above, followed by skipping to the scanning line separated by m lines from this scanning line, and again returning to the scanning line of the next stage thereof (that is, in the sequence of scanning line $G_1$, scanning line $G_{m+1}$, scanning line $G_2$, scanning line $G_{m+2}$, scanning line $G_3$, and so on).

On the other hand, regarding the data signal Sx which is the output from the data driver 201, the polarity is inverted into a positive polarity potential or a negative polarity potential for each one horizontal period of the writing, centered on the common potential LCCOM. Consequently, while on the data signal Sx side the polarity is being inverted for each one horizontal period of the writing, on the gate pulse side the gate pulse is alternately output to two locations of the screen which are separated by m scanning lines, in the aforementioned sequence. As a result, on the screen, as shown in FIG. 9, observing a certain one horizontal period, then for example the dots corresponding to scanning lines $G_3$ to $G_{m+2}$ become the area in which the data of positive polarity potential is written (hereinafter, simply referred to as the positive polarity area), and the dots corresponding to the scanning lines $G_1$ to $G_2$ and $G_{m+3}$ to $G_{2m}$ become the area in which the data of negative polarity potential is written (hereinafter, simply referred to as the negative polarity area), giving a condition as if the inside the screen were divided into three areas, namely a positive polarity area and two negative polarity areas where data of different polarities is written. That is to say, in the present embodiment, although the way of setting up the enable signals is different, scanning similar to that of the first embodiment is performed.

In other words, in the present embodiment, one field data is made a consecutive first and second field data, and while writing an image signal input from the outside as is, as the first field data, this image signal is stored in the aforementioned memory, to create a second field data which is delayed with respect to the aforementioned image signal, and these field data are alternately written in, with the polarity of the second field data inverted with respect to the first field data.

For this reason, in the present embodiment also, non-uniformity of the display depending on the location on the screen can be avoided while suppressing cross-talk. Furthermore, in the present embodiment, since one field data is divided into two field data, and an image signal input from the outside is used as is for one field data, then the image is actually read in at twice the speed (that is, a frequency of twice that of the image signal input from the outside). Normally, in the case of carrying out double speed driving, a memory capacity for two screen parts (field parts) is necessary. However, with the present configuration, since half of the screen is written by outputting the image signal from the outside as is to the data line, the memory capacity need only be half the capacity of the whole display screen (that is, a ½ field part). For this reason, compared to the ordinary configuration, the memory capacity need only be ¼, and hence material cost can be significantly reduced. In addition, with the present embodiment, since double speed writing is carried out for the pixel, flicker is suppressed.

Projection Type Liquid Crystal Display Apparatus

Figure 14:
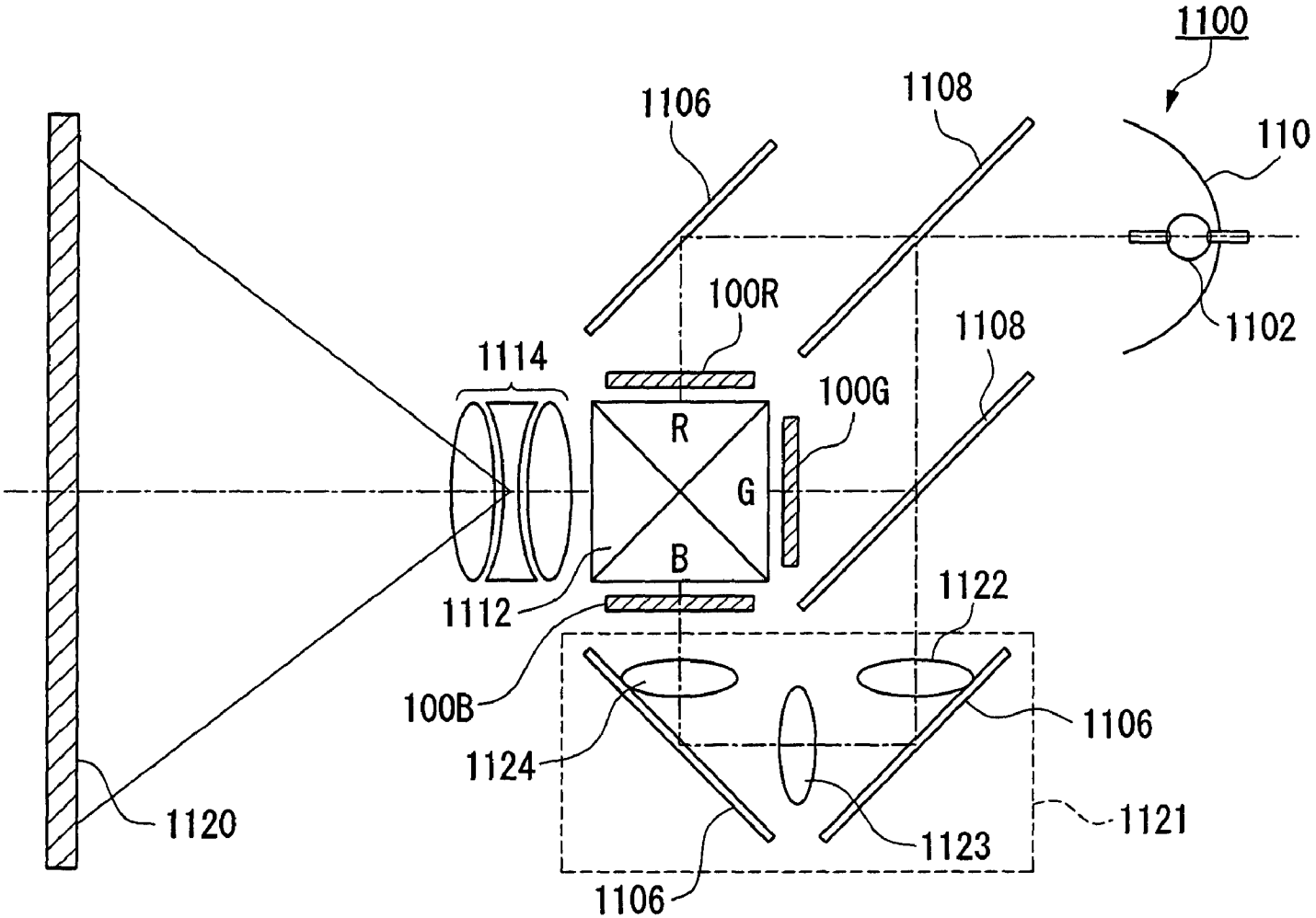
FIG. 14 is a schematic block diagram showing an example of a projection type display apparatus using the liquid crystal device of the present invention.

FIG. 14 is a schematic block diagram showing an example of a projection type liquid crystal display apparatus (liquid crystal projector) of the so-called three plate type, which uses three liquid crystal light valves of the aforementioned embodiment. In the figure, reference symbol 1100 denotes a light source, 1108 denotes a dichroic mirror, 1106 denotes a reflection mirror, 1122, 1123, and 1124 denote relay lenses, 100R, 110G, and 110B denote liquid crystal light valves, 1112 denotes a cross dichroic prism, and 1114 denotes a projection lens system.

The light source 1100 comprises a lamp 1102 such as a metal halide lamp, and a reflector 1101 which reflects light from the lamp 1102. The dichroic mirror 1108 for reflecting blue light and green light, transmits red light of white light from the light source 1100, and reflects the blue light and green light. The transmitted red light is reflected by the reflecting mirror 1106, and input to the liquid crystal light valve for red light 100R.

On the other hand, among the colored lights reflected by the dichroic mirror 1108, the green light is reflected by the dichroic mirror 1108 for reflecting green light, and input to the liquid crystal light valve for green light 100G. On the other hand, the blue light also passes through the second dichroic mirror 1108. For the blue light, in order to compensate for the difference in the optical paths for the green light and the red light, there is provided a light guide device 1121 comprising a relay lens system including an incidence lens 1122, a relay lens 1123, and an output lens 1124, and the blue light is input via these to the liquid crystal light valve for blue light 100B.

The three colored lights which are modulated by the respective light valves 100R, 100G, and 100B are input to the cross dichroic prism 1112. This prism is one where four rectangular prisms are affixed together, and on the inside face, a dielectric multilayer film which reflects red light and a dielectric multilayer film which reflects blue light are formed in a cross shape. By means of these dielectric multilayer films, the three colored lights are synthesized to form light representing the color image. The synthesized light is projected onto a screen 1120 by means of the projection lens system 1114, which is the projection optical system, to display an enlarged image.

In the projection type liquid crystal display apparatus of the above configuration, by using the liquid crystal light valve of the aforementioned embodiment, a projection type liquid crystal display device having superior display uniformity can be realized.

The technical scope of the present invention is not limited to the aforementioned embodiments, and various modifications within a range which does not deviate from the gist of the present invention can be made. For example, in the aforementioned embodiment, the example was given in which the screen is divided into two areas or four areas for writing different polarity potentials, but the number of divisions is not limited to these, and the number of divisions may be made even greater. However, with a larger number of divisions, the time to the resulting condition where the inverse polarity potential is applied to adjacent scanning lines becomes longer. Even in this case, it is preferable to have a condition where the same polarity potential is applied at a proportion not less than 50% of the one vertical period, in view of time. Furthermore, concerning the sequence of scanning within each area, this is not limited to that in the aforementioned embodiments, and may be appropriately modified.

Moreover, in the aforementioned fourth embodiment, one field data was divided into two field data, but instead of this, one field data may also be divided into three or more field data. In this case, an image signal from the outside is used for any one of the field data, and individual separate data stored in the memory is used for the other field data.

Additionally, in the aforementioned embodiments, an active matrix type liquid crystal device using a TFT was described as an example; however, the present invention is not limited to this. For example, the present invention can also be applied to display devices of various types which matrix-drive plural pixels, such as a device which uses a TFD (thin film diode) for the pixel switching element, or a device of a passive matrix type.

As described in detail above, according to the present invention, non-uniformity of display depending on the location on the screen can be avoided while suppressing cross-talk, so that a liquid crystal device in which problems such as insufficient writing do not occur can be realized.

What is claimed is:

1. A liquid crystal device, comprising:

plural data lines;

plural scanning lines intersecting the data lines;

plural pixels provided in an array inside an image display area, by corresponding to intersections of respective data lines and scanning lines; and a driver section which supplies image signals to the pixels, wherein the driver section comprises a data driver which supplies an image signal for which a potential is inverted into a positive polarity potential or a negative polarity potential for each one horizontal period, to each of said plural data lines, and a scanning driver which sequentially shifts a gate-output pulse in synchrony with a clock signal which rises for each one horizontal period, and n ($n \geqq 2$) gate-output pulses are supplied to the scanning driver at a different timing within one vertical period in a picture signal, the scanning driver shifts each of the n gate-output pulses in synchrony with the clock signals, and also supplies a scanning signal to each scanning line, based on each of alternately rising m enable signals and each of the n gate pulses, n and m being positive integers.

2. The liquid crystal device according to claim 1, wherein;

the n gate-output pulses are two gate-output pulses, the two gate-output pulses are supplied to the scanning driver with a time lag of ½ of a vertical period in the image signal each other, the scanning driver outputs two scanning signals alternately based on each of the two gate-output pulses and each of first and second two alternately rising enable signals each of the two scanning signals is supplied to each of two scanning lines, and a distance between the two scanning lines is corresponding to ½ of the image display area.

3. The liquid crystal device according to claim 1, wherein the four gate-output pulses are supplied to the scanning driver with a time lag of ¼ of a vertical period in the image signal each other, the scanning driver outputs four scanning signals alternately based on each of the four gate-output pulses and each of first through fourth four alternately rising enable signals each of the four scanning signals is supplied to each of four scanning lines, and a distance between each of the four scanning lines is corresponding to ¼ of the image display area.

4. The liquid crystal device according to claim 1, wherein a memory is provided in said driver section, while an image signal input from the outside is being supplied to said data driver, the image signal is also stored in said memory, and said data driver alternately supplies in each of the one horizontal periods, an image signal input from the outside, and image data read out from said memory, and also inverts the polarity of the image data read out from said memory with respect to said image signal, to thereby supply an image signal for which the polarity is inverted into the positive polarity potential or the negative polarity potential for each one horizontal period, to each of said plural data lines.

5. A drive method for a liquid crystal device that includes plural data lines, plural scanning lines intersecting the data lines, plural pixels provided in an array inside an image display area, by corresponding to intersections of respective data lines and scanning lines, and a driver section which supplies image signals to the pixels, the method comprising:

supplying, with a data driver of the driver section, an image signal for which a potential is inverted into a positive polarity potential or a negative polarity potential for each one horizontal period, to each of the plural data lines;

sequentially shifting, with a scanning driver of the driver section, a gate-output pulse in synchrony with a clock signal which rises for each one horizontal period;

supplying ($n \geqq 2$) gate-output pulses to the scanning driver at a different timing within one vertical period in a picture signal;

shifting, with the scanning driver, each of the n gate-output pulses in synchrony with the clock signals; and supplying, with the scanning driver, a scanning signal to each scanning line, based on each of alternatively rising m enable signals and each of the n gate pulses.

* * * * *